US007508672B2

(12) United States Patent
Hamman

(10) Patent No.: US 7,508,672 B2
(45) Date of Patent: Mar. 24, 2009

(54) COOLING SYSTEM

(75) Inventor: Brian A. Hamman, Aubrey, TX (US)

(73) Assignee: QNX Cooling Systems Inc., Krugerville, TX (US)

( * ) Notice: Subject to any disclaimer, the term of this patent is extended or adjusted under 35 U.S.C. 154(b) by 693 days.

(21) Appl. No.: 10/688,587

(22) Filed: Oct. 18, 2003

(65) Prior Publication Data

US 2005/0083656 A1 Apr. 21, 2005

Related U.S. Application Data

(63) Continuation-in-part of application No. 10/666,189, filed on Sep. 10, 2003, now Pat. No. 6,999,316.

(51) Int. Cl.
*H05K 7/20* (2006.01)

(52) U.S. Cl. ..... 361/701; 361/688; 361/689; 361/695; 361/699; 165/104.33; 174/15.1

(58) Field of Classification Search ..... None
See application file for complete search history.

(56) References Cited

U.S. PATENT DOCUMENTS 3,609,991 A * 10/1971 Chu et al. ..... 62/333
5,285,347 A * 2/1994 Fox et al. ..... 361/699
5,473,508 A 12/1995 Porter et al.
5,574,627 A * 11/1996 Porter ..... 361/719
5,587,880 A * 12/1996 Phillips et al. ..... 361/687
5,731,954 A * 3/1998 Cheon ..... 361/699
5,731,964 A 3/1998 Kitakubo et al.
5,823,005 A * 10/1998 Alexander et al. ..... 62/259.2
5,873,253 A * 2/1999 Camphous ..... 62/62
5,998,863 A * 12/1999 Kobayashi et al. ..... 257/715
6,142,222 A * 11/2000 Kang et al. ..... 165/148
6,166,907 A * 12/2000 Chien ..... 361/699
6,196,003 B1 * 3/2001 Macias et al. ..... 62/3.7
6,208,512 B1 * 3/2001 Goldowsky et al. ..... 361/699
6,263,957 B1 7/2001 Chen et al.
6,313,990 B1 11/2001 Cheon
6,360,814 B1 * 3/2002 Tanaka et al. ..... 165/104.33
6,408,937 B1 * 6/2002 Roy ..... 165/104.33
6,529,376 B2 3/2003 Hamman
6,587,343 B2 * 7/2003 Novotny et al. ..... 361/698
6,668,911 B2 * 12/2003 Bingler ..... 165/80.4
6,754,076 B2 * 6/2004 Cox et al. ..... 361/699
6,771,500 B1 * 8/2004 Siegel et al. ..... 361/699
6,776,221 B2 * 8/2004 Montgomery et al. ..... 165/46
6,894,899 B2 * 5/2005 Wu et al. ..... 361/699
6,906,919 B2 * 6/2005 Pokharna et al. ..... 361/687
6,973,801 B1 * 12/2005 Campbell et al. ..... 62/259.2

(Continued)

*Primary Examiner*—Boris L Chervinsky
(74) *Attorney, Agent, or Firm*—Patent Dominio LP

(57) ABSTRACT

Liquid cooling systems and apparatus are presented. A number of embodiments are presented. In each embodiment a heat transfer system capable of engaging a processor and adapted to transfer heat from the processor is implemented. A variety of embodiments of the heat transfer system are presented. For example, several embodiments of a direct-exposure heat transfer system are presented. In addition, several embodiments of a multi-processor heat transfer systems are presented. Lastly, several embodiments of heat transfer systems deployed in circuit boards are shown. Each of the heat transfer systems is in liquid communication with a heat exchange system that receives heated liquid from the heat transfer system and returns cooled liquid to the heat transfer system.

32 Claims, 20 Drawing Sheets

U.S. PATENT DOCUMENTS 7,032,392 B2 * 4/2006 Koeneman et al. ..... 62/77
7,055,341 B2 * 6/2006 Nori et al. ..... 62/259.2
7,251,137 B2 * 7/2007 Iijima et al. ..... 361/699
7,397,662 B2 * 7/2008 Oyamada ..... 361/699
2003/0209343 A1 * 11/2003 Bingler ..... 165/80.4
2004/0035555 A1 * 2/2004 Nara et al. ..... 165/84
2004/0095721 A1 * 5/2004 Ellsworth et al. ..... 361/694
2005/0168948 A1 * 8/2005 Cader et al. ..... 361/699
2005/0180105 A1 * 8/2005 Matsushima et al. ..... 361/699

* cited by examiner

COOLING SYSTEM

CROSS REFERENCE TO RELATED APPLICATIONS

The present invention is a continuation-in-part of application Ser. No. 10/666,189, filed Sep. 10, 2003 now U.S. Pat. No. 6,999,316, entitled "Liquid Cooling System," and which is herein incorporated by reference.

BACKGROUND OF THE INVENTION

Description of the Related Art

Processors are at the heart of most computing systems. Whether a computing system is a desktop computer, a laptop computer, a communication system, a television, etc., processors are often the fundamental building block of the system. These processors may be deployed as central processing units, as memories, controllers, etc.

As computing systems advance, the power of the processors driving these computing systems increases. The speed and power of the processors are achieved by using new combinations of materials, such as silicon, germanium, etc., and by populating the processor with a larger number of circuits. The increased circuitry per area of processor as well as the conductive properties of the materials used to build the processors result in the generation of heat. Further, as these computing systems become more sophisticated, several processors are implemented within the computing system and generate heat. In addition to the processors, other systems operating within the computing system may also generate heat and add to the heat experienced by the processors.

A range of adverse effects result from the increased heat. At one end of the spectrum, the processor begins to malfunction from the heat and incorrectly processes information. This may be referred to as computing breakdown. For example, when the circuits on a processor are implemented with digital logic devices, the digital logic devices may incorrectly register a logical zero or a logical one. For example, logical zeros may be mistaken as logical ones or vice versa. On the other hand, when the processors become too heated, the processors may experience a physical breakdown in their structure. For example, the metallic leads or wires connected to the core of a processor may begin to melt and/or the structure of the semiconductor material (i.e., silicon, germanium, etc.) itself may breakdown once certain heat thresholds are met. These types of physical breakdowns may be irreversible and render the processor and the computing system inoperable and unrepairable.

A number of approaches have been implemented to address processor heating. Initial approaches focused on air-cooling. These techniques may be separated into three categories: 1) cooling techniques which focused on cooling the air outside of the computing system; 2) cooling techniques that focused on cooling the air inside the computing system; and 3) a combination of the cooling techniques (i.e., 1 and 2).

Many of these conventional approaches are elaborate and costly. For example, one approach for cooling air outside of the computing system involves the use of a cold room. A cold room is typically implemented in a specially constructed data center, which includes air conditioning units, specialized flooring, walls, etc., to generate and retain as much cooled air within the cold room as possible.

Cold rooms are very costly to build and operate. The specialized buildings, walls, flooring, air conditioning systems, and the power to run the air conditioning systems all add to the cost of building and operating the cold room. In addition, an elaborate ventilation system is typically also implemented and in some cases additional cooling systems may be installed in floors and ceilings to circulate a high volume of air through the cold room. Further, in these cold rooms, computing equipment is typically installed in specialized racks to facilitate the flow of cooled air around and through the computing system. However, with decreasing profit margins in many industries, operators are not willing to incur the expenses associated with operating a cold room. In addition, as computing systems are implemented in small companies and in homes, end users are unable and unwilling to incur the cost associated with the cold room, which makes the cold room impractical for this type of user.

The second type of conventional cooling technique focused on cooling the air surrounding the processor. This approach focused on cooling the air within the computing system. Examples of this approach include implementing simple ventilation holes or slots in the chassis of a computing system, deploying a fan within the chassis of the computing system, etc. However, as processors become more densely populated with circuitry and as the number of processors implemented in a computing system increases, cooling the air within the computing system can no longer dissipate the necessary amount of heat from the processor or the chassis of a computing system.

Conventional techniques also involve a combination of cooling the air outside of the computing system and cooling the air inside the computing system. However, as with the previous techniques, this approach is also limited. The heat produced by processors has quickly exceeded beyond the levels that can be cooled using a combination of the air-cooling techniques mentioned above.

Other conventional methods of cooling computing systems include the addition of heat sinks. Very sophisticated heat sink designs have been implemented to create heat sinks that can remove the heat from a processor. Further, advanced manufacturing techniques have been developed to produce heat sinks that are capable of removing the vast amount of heat that can be generated by a processor. However, in most heat sinks, the size of the heat sink is directly proportional to the amount of heat that can be dissipated by the heat sink. Therefore, the more heat to be dissipated by the heat sink, the larger the heat sink. Certainly, larger heat sinks can always be manufactured; however, the size of the heat sink can become so large that heat sinks become infeasible.

Refrigeration techniques and heat pipes have also been used to dissipate heat from a processor. However, each of these techniques has limitations. Refrigeration techniques require substantial additional power, which drains the battery in a computing system. In addition, condensation and moisture, which is damaging to the electronics in computing systems, typically develops when using the refrigeration techniques. Heat pipes provide yet another alternative; however, conventional heat pipes have proven to be ineffective in dissipating the large amount of heat generated by a processor.

In yet another approach for managing the heat issues associated with a processor, designers have developed methods for controlling the operating speed of a processor to manage the heat generated by the processor. In this approach, the processing speed is throttled based on the heat produced by the processor. For example, as the processor heats to dangerous limits (i.e., computing breakdown or structural breakdown), the processing speed is stepped down to a lower speed.

At the lower speed, the processor is able to operate without experiencing computing breakdown or structural breakdown. However, this often results in a processor operating at a level below the level that the processor was marketed to the public or rated. This also results in slower overall performance of the computing system. For example, many conventional chips incorporate a speed step methodology. Using the speed step method, a processor reduces its speed by a percentage once the processor reaches a specific thermal threshold. If the processor continues to heat up to the second thermal threshold, the processor will reduce its speed by an additional 25 percent of its rated speed. If the heat continues to rise, the speed step methodology will continue to reduce the speed to a point where the processor will stop processing data and the computer will cease to function.

As a result of implementing the speed step technology, a processor marketed as a one-gigahertz processor may operate at 250 megahertz or less. Therefore, although this may protect a processor from structural breakdown or computing breakdown, it reduces the operating performance of the processor and the ultimate performance of the computing system. While this may be a feasible solution, it is certainly not an optimal solution because processor performance is reduced using this technique. Therefore, thermal (i.e., heat) issues negate the tremendous amount of research and development expended to advance processor performance.

In addition to the thermal issues, a heat dissipation method and/or apparatus must be deployed in the chassis of a computing system, which has limited space. Further, as a result of the competitive nature of the electronics industry, the additional cost for any heat dissipation method or apparatus must be very low or incremental.

Thus, there is a need in the art for a method and apparatus for cooling computing systems. There is a need in the art for a method and apparatus for cooling processors deployed within a computing system. There is a need in the art for an optimal, cost-effective method and apparatus for cooling processors, which also allows the processor to operate at the marketed operating capacity. There is a need for a method or apparatus used to dissipate processor heat which can be deployed within the small footprint available in the case or housing of a computing system, such as a laptop computer, standalone computer, cellular telephone, etc.

SUMMARY OF THE INVENTION

A method and apparatus for dissipating heat from processors are presented. A variety of heat transfer systems are implemented. Liquid is used in combination with the heat transfer system to dissipate heat from a processor. Each heat transfer system is combined with a heat exchange system. Each heat exchange system receives heated liquid and produces cooled liquid.

During operation, each heat transfer system may be mated with a processor, which produces heat. Liquid is processed through the heat transfer system to dissipate the heat. As the liquid is processed through the heat transfer system the liquid becomes heated liquid. The heated liquid is transported to the heat exchange system. The heat exchange system receives the heated liquid and produces cooled liquid. The cooled liquid is then transported back to the heat transfer system to dissipate the heat produced by the processor.

A liquid cooling system comprises a housing; a receptacle disposed in the housing, the receptacle capable of mating with packaging material associated with a processor to form a cavity, the processor generating heat; an inlet disposed in the housing, the inlet receiving liquid, the liquid flowing through the cavity and removing the heat by flowing across the packaging material; and an outlet disposed in the housing, the outlet providing an exit point for the liquid flowing through the cavity.

The liquid cooling system, further comprises a first conduit coupled to the outlet, the first conduit transporting heated liquid in response to the liquid flowing through the cavity; a heat exchange system coupled to the first conduit, the heat exchange system receiving the heated liquid transported on the first conduit and generating cooled liquid; and a second conduit coupled to the inlet and coupled to the heat exchange system, the inlet receiving the liquid in response to transporting the cooled liquid on the second conduit.

In one embodiment, the cooling system as set forth above, wherein the cooling system is disposed in a casing, the cooling system further comprising a heat exchange system including a heat dissipater in fluid communication with the outlet; a cavity in liquid communication with the heat dissipater for receiving cooled coolant; and a pump disposed within the cavity for circulating the liquid coolant through the cooling system.

In one embodiment, the liquid cooling system as set forth above, further comprising, a first conduit coupled to the outlet, the first conduit transporting heated liquid in response to the liquid flowing through the cavity; a heat exchange system coupled to the first conduit, the heat exchange system further comprising, a heat dissipater generating cooled liquid in response to receiving the heated liquid, a liquid cavity housing the cooled liquid, and a fan positioned between a heat dissipater and the liquid cavity, the fan causing air flow over the heat dissipater and the liquid cavity; and a second conduit coupled to the inlet and coupled to the liquid cavity, the inlet receiving the cooled liquid in response to transporting the cooled liquid on the second conduit.

A liquid cooling system comprises a housing; a receptacle disposed in the housing, the receptacle capable of mating with packaging material associated with a processor to form a cavity, the processor generating heat; a pump disposed in the cavity and pumping liquid through the cavity, the liquid flowing through the cavity and removing the heat by making contact with the packaging material in response to the pump pumping liquid through the cavity; an inlet disposed in the housing, the inlet receiving the liquid in response to the pump pumping the liquid through the cavity; and an outlet disposed in the housing, the outlet outputting the liquid in response to the pump pumping the liquid through the cavity.

A cooling system comprises a first conduit transporting first liquid; a first heat transfer unit coupled to the first conduit and capable of mating with a processor on a first side, the processor generating heat, the first heat transfer unit capable of removing heat by conveying the first liquid through the first heat transfer unit; a second heat transfer unit coupled to the first conduit and capable of mating with the processor on a second side, the second heat transfer unit capable of further removing heat by conveying the first liquid through the second heat transfer unit; and a second conduit coupled to the first heat transfer unit and coupled to the second heat transfer unit, the second conduit transporting second liquid in response to conveying the first liquid through the first heat transfer unit and in response to conveying first liquid through the second heat transfer unit.

A liquid cooling system comprises a first housing comprising a receptacle capable of mating with first packaging material associated with a processor, to form a first cavity, the processor generating heat; a second housing comprising a receptacle capable of mating with second packaging material associated with the processor, to form a second cavity; a first inlet disposed in the first housing, the first inlet receiving first liquid, the first liquid flowing through the first cavity and removing the heat by making contact with the first packaging material; a second inlet disposed in the second housing, the second inlet receiving second liquid, the second liquid flowing through the second cavity and removing the heat by making contact with the second packaging material; a first outlet disposed in the first housing, the first outlet providing and exit point for the first liquid flowing through the first cavity; and a second outlet disposed in the second housing, the second outlet providing and exit point for the second liquid flowing through the second cavity.

A cooling system comprises a first conduit transporting first liquid; a first heat transfer system coupled to the first conduit and capable of mating with a first processor on a first side, the first processor generating first heat, the first heat transfer unit capable of removing first heat by conveying the first liquid through the first heat transfer system; a second heat transfer system coupled to the first conduit and capable of mating with the first processor on a second side and a second processor on a first side, the second heat transfer system capable of further removing first heat by conveying the first liquid through the second heat transfer system and the second heat transfer system capable of removing second heat by conveying the first liquid through the second heat transfer system; a third heat transfer system coupled to the first conduit and capable of mating with the second processor on a second side, the third heat transfer system capable of further removing second heat by conveying the first liquid through the third heat transfer system; and a second conduit coupled to the first heat transfer system, coupled to the second heat transfer system and coupled to the third heat transfer system, the second conduit transporting second liquid in response to conveying the first liquid through the first heat transfer system, in response to conveying first liquid through the second heat transfer system and in response to conveying first liquid through the third heat transfer system.

A cooling system comprises a first housing comprising a first receptacle capable of mating with first packaging material associated with a first processor, to form a first cavity, the first processor generating first heat; a second housing comprising a second receptacle capable of mating with second packaging material associated with the first processor and comprising a third receptacle capable of mating with third packaging material associated with a second processor, to form a second cavity, the second processor generating second heat; a third housing comprising a fourth receptacle capable of mating with fourth packaging material associated with the second processor, to form a third cavity; a first inlet disposed in the first housing, the first inlet receiving first liquid, the first liquid flowing through the first cavity and removing first heat by making contact with the first packaging material; a second inlet disposed in the second housing, the second inlet receiving second liquid, the second liquid flowing through the second cavity and removing first heat by making contact with the second packaging material, the second liquid flowing through the second cavity and removing second heat by making contact with the second packaging material; a third inlet disposed in the third housing, the third inlet receiving third liquid, the third liquid flowing through the third cavity and removing second heat by making contact with the fourth packaging material; a first outlet disposed in the first housing, the first outlet providing and exit point for the first liquid flowing through the first cavity; a second outlet disposed in the second housing, the second outlet providing and exit point for the second liquid flowing through the second cavity; and a third outlet disposed in the third housing, the third outlet providing and exit point for the third liquid flowing through the third cavity.

A liquid cooling system comprises a first conduit transporting liquid; a cavity coupled to the first conduit, the cavity mating with packaging material deployed on multiple sides of a processor, the processor generating heat, the cavity conveying the liquid in response to transporting the liquid on the first conduit, the liquid dissipating the heat; and a second conduit coupled to the cavity, the second conduit transporting liquid in response to the cavity conveying the liquid.

A cooling system comprises a circuit board capable of receiving a processor generating heat; a heat conducting material deployed within the circuit board and receiving the heat from the processor; and a conduit coupled to the heat conducting material, the conduit removing heat in the heat conducting material by transporting coolant through the conduit.

A liquid cooling system comprises a circuit board capable of receiving a processor generating heat; a heat conducting material deployed within the circuit board and receiving heat from the processor, the heat conducting material forming a cavity, the cavity providing a conduit for coolant to flow through the cavity, the coolant removing heat; an conduit coupled to the cavity, the conduit providing and entry point for the coolant; and an conduit coupled to the cavity, the conduit providing and exit point for the coolant.

DETAILED DESCRIPTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

A variety of liquid cooling systems are presented. In each embodiment of the present invention, a heat transfer system in combination with a heat exchange system is used to dissipate heat from a processor. The various heat transfer systems may be intermixed with the heat exchange systems to create a variety of liquid cooling systems.

Several heat transfer systems are presented. Each heat transfer system may be used with a variety of heat exchange systems. For example, a heat transfer system is presented; a direct-exposure heat transfer system is presented; a dual-surface heat transfer system is presented; a dual-surface, direct-exposure heat transfer system is presented; a multi-processor, heat transfer system is presented; a multi-processor, dual-surface direct exposure heat transfer system is presented; a multi-surface heat transfer system is presented; a multi-surface, direct-emersion heat transfer system is presented; a circuit-board heat transfer system is presented. In addition, it should be appreciated that combinations and variations of the foregoing heat transfer systems may be implemented and are within the scope of the present invention.

Figure 1:
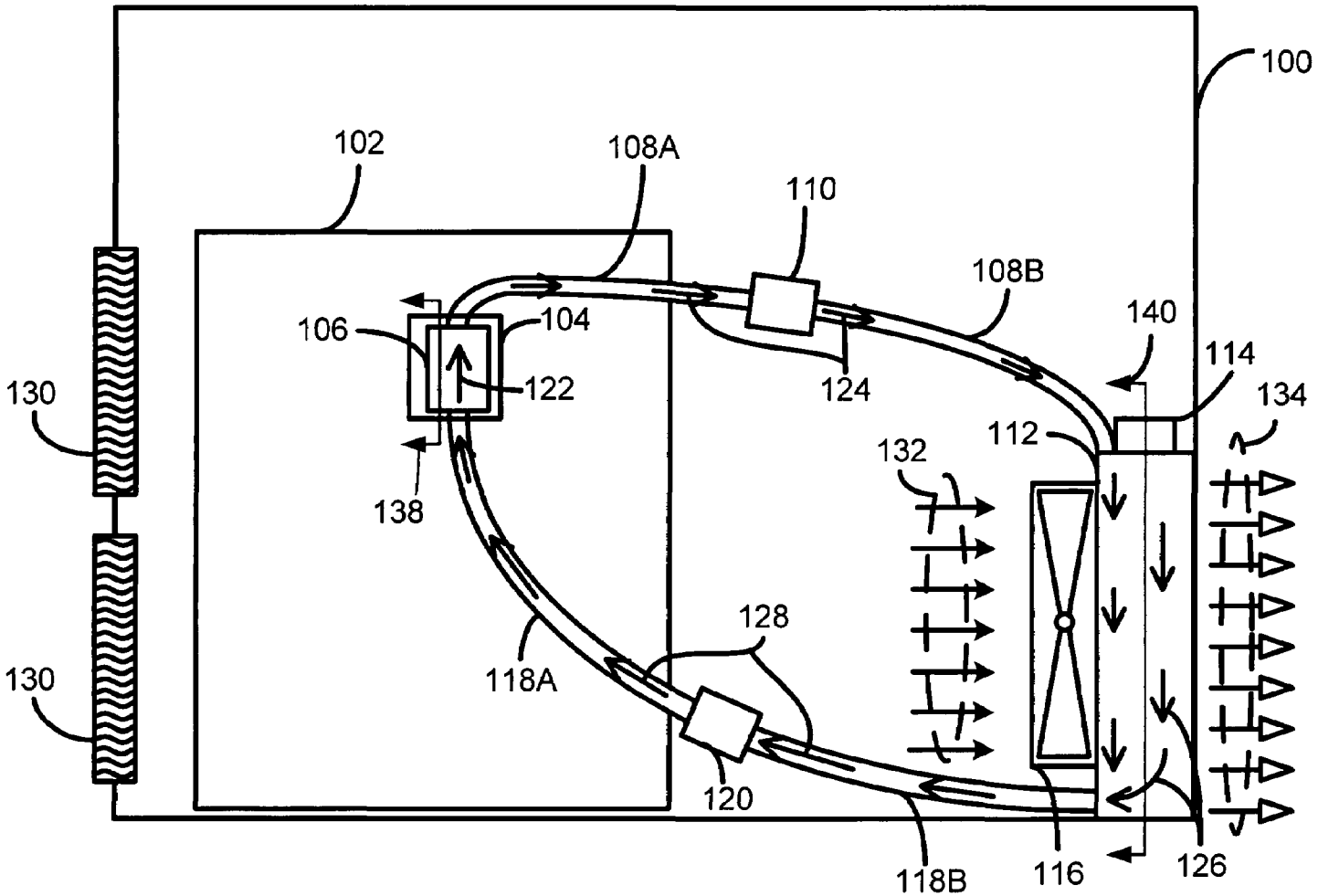
FIG. 1 displays a system view of a liquid cooling system disposed in a housing and implemented in accordance with the teachings of the present invention.
Figure 2:
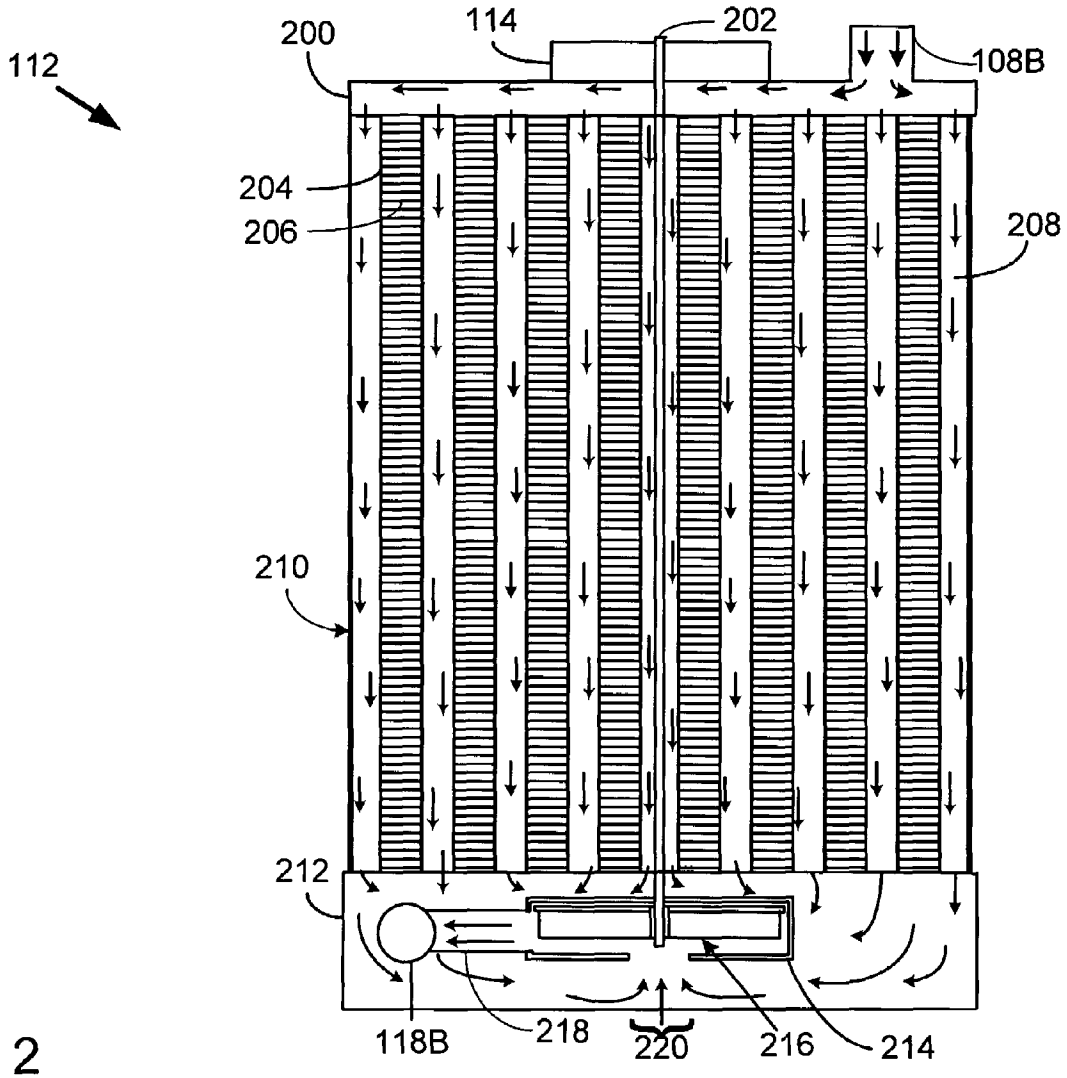
FIG. 2 displays a sectional view of a heat exchange system implemented in accordance with the teachings of the present invention.
Figure 3:
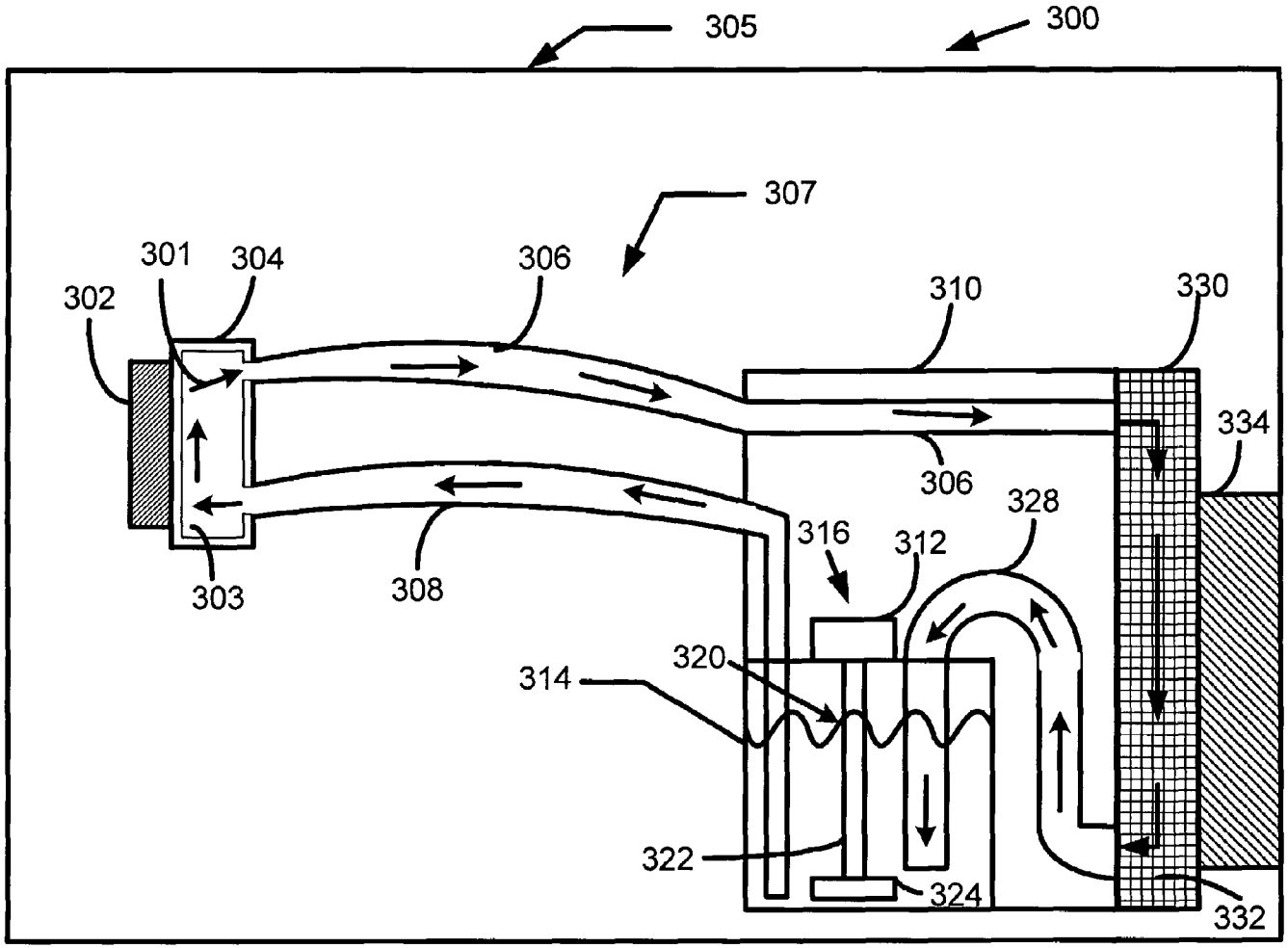
FIG. 3 displays a system view of a liquid cooling system disposed in a housing and implemented in accordance with the teachings of the present invention.
Figure 4B:
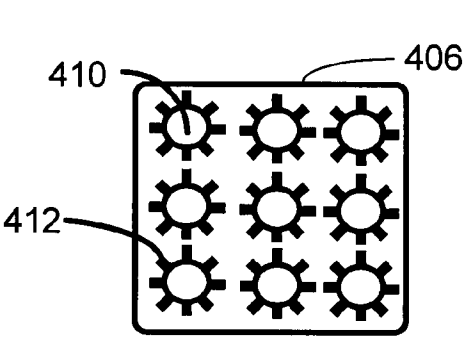
FIG. 4B displays a cross-sectional view of the heat exchange system depicted in FIG. 4A.

In addition to the heat transfer systems, heat exchange systems are presented. For example, a first heat exchange system is depicted in FIGS. 1 and 2; a second heat exchange system is depicted in FIG. 3; a fourth heat exchange system is depicted in FIG. 4; a fifth heat exchange system as depicted in FIG. 5. It should be appreciated that each of the foregoing heat exchange systems may be implemented with any one of the foregoing heat transfer systems presented above.

In one embodiment of the present invention, a two-piece cooling system having no reservoir is presented. The two-piece cooling system includes: (1) a heat transfer system, which is capable of attachment to a processor, and (2) a heat exchange system. In one embodiment, a single conduit is used to couple the heat transfer system to the heat exchange system. In a second embodiment, a conduit transporting heated and a conduit transporting cooled are used to couple the heat transfer system to the heat exchange system. It should also be appreciated that the two-piece liquid cooling system may also be deployed as a one-piece liquid cooling system by deploying the heat transfer system and the heat exchange system in a single unit (i.e., a single consolidated embodiment).

The two-piece liquid cooling system utilizes several mechanisms to dissipate heat from a processor. In one embodiment, liquid is circulated in the two-piece liquid cooling system to dissipate heat from the processor. The liquid is circulated in two ways. In one embodiment, power is applied to the two-piece liquid cooling system and the liquid is pumped through the two-piece liquid cooling system to dissipate heat from the processor. For the purposes of this discussion, this is referred to as forced liquid circulation.

In a second embodiment, liquid input points and exit points are specifically chosen in the heat transfer system and the heat exchange system to take advantage of the heating and cooling of the liquid and the momentum resulting from the heating and cooling of the liquid. For the purposes of discussion, this is referred to as convective liquid circulation.

In another embodiment, air-cooling is used in conjunction with the liquid cooling to dissipate heat from the processor. In one embodiment, the air-cooling is performed by strategically placing fans in the housing of the computing system. In a second embodiment, the air-cooling is performed by strategically placing a fan relative to the heat exchange system to increase the cooling performance of the heat exchange system. In yet another embodiment, heated air is expelled from the system during cooling to provide for a significant dissipation of heat.

FIG. 1 displays a system view of a cooling system disposed in a housing and implemented in accordance with the teachings of the present invention. A housing or case 100 is shown. In one embodiment, the housing or case 100 may be a computer case, such as a standalone computer case, a laptop computer case, etc. In another embodiment, the housing or case 100 may include the case for a communication device, such as a cellular telephone case, etc. It should be appreciated that the housing or case 100 will include any case or containment unit, which houses a processor or other heat generating components.

The housing or case 100 includes a motherboard 102. The motherboard 102 includes any board that contains a processor 104. A motherboard 102 implemented in accordance with the teachings of the present invention may vary in size and include additional electronics and processors. In one embodiment, the motherboard 102 may be implemented with a printed circuit board (PCB).

A processor 104 is disposed in the motherboard 102. The processor 104 may include any type of processor 104 deployed in a modern computing system. For example, the processor 104 may be an integrated circuit, a memory, a microprocessor, an opto-electronic processor, an application specific integrated circuit (ASIC), a field programmable gate array (FPGA), an optical device, etc., or a combination of foregoing processors.

In one embodiment, the processor 104 is connected to the heat transfer system 106 using a variety of connection techniques. For example, attachment devices, such as clips, pins, etc., are used to attach the heat transfer system 106 to the processor 104. In addition, mechanisms for providing for a quality contact (i.e., good heat transfer), such as epoxies, etc., may be disposed between the heat transfer system 106 and the processor 104 and are within the scope of the present invention.

The heat transfer system 106 includes a cavity (not shown in FIG. 1) through which liquid flows in a direction denoted by liquid direction arrow 122. In one embodiment, the heat transfer system 106 is manufactured from a material, such as copper, which facilitates the transfer of heat from the processor 104. In another embodiment, the heat transfer system 106 may be constructed with a variety of materials, which work in a coordinated manner to efficiently transfer heat away from the processor 104. It should be appreciated that the heat transfer system 106 and the processor 104 may vary in size. For example, in one embodiment, the heat transfer system 106 may be larger than the processor 104. A variety of heat transfer systems suitable for use as heat transfer system 106 are presented throughout the instant application. Many of the heat transfer systems are shown with a sectional view such as a view shown along sectional lines 138.

A conduit denoted by 108A/108B is connected to the heat transfer system 106. In one embodiment, the conduit 108A/108B may be built into the body of the heat transfer system 106. In another embodiment, the conduit 108A/108B may be connected and detachable from heat transfer system 106. In one embodiment, the conduit 108A/108B is a liquid pathway that facilitates the transfer of liquid from the heat transfer system 106.

A conduit 118A/118B is connected to the heat transfer system 106. In one embodiment, the conduit 118A/118B may be built into the body of the heat transfer system 106. In another embodiment, the conduit 118A/118B may be connected and detachable from heat transfer system 106. In one embodiment, the conduit 118A/118B is a liquid pathway that facilitates the transfer of liquid to the heat transfer system 106.

In one embodiment, the conduit 108A/108B and the conduit 118A/118B may be combined into a single conduit coupling the heat transfer system 106 to the heat exchange system 112, where the single conduit transports both the heated and cooled liquid. In another embodiment, the conduit 108A/108B and the conduit 118A/118B may be combined into a single conduit coupling the heat transfer system 106 to the heat exchange system 112, where the single conduit is segmented into two conduits, one for transporting the heated liquid and one for transporting the cooled liquid. In addition, in one embodiment, an opening or liquid pathway transferring liquid directly between the heat transfer system 106 and the heat exchange system 112 without traversing any intermediate components (i.e., other than conduit connectors) may be considered a conduit, such as conduit 108A/108B and/or conduit 118A/118B. Both the conduit 108A/108B and the conduit 118A/118B may be made from a plastic material, metallic material, or any other material that would provide the desired characteristics for a specific application.

In one embodiment, the conduit 108A/108B includes three components: conduit 108A, connection unit 110, and conduit 108B. Conduit 108A is connected between the heat transfer system 106 and the connection unit 110. Conduit 108B is connected between connection unit 110 and heat exchange system 112. However, it should be appreciated that in one embodiment, a single uniform connection may be considered a conduit 108A/108B. In a second embodiment, the combination of conduit 108A, 110, and 108B may combine to form a single conduit.

In one embodiment, the conduit 118A/118B may also include three components: conduit 118B, connection unit 120, and conduit 118B. Conduit 118A is connected between the heat transfer system 106 and the connection unit 120. Conduit 118B is connected between connection unit 120 and heat exchange system 112. However, it should be appreciated that in one embodiment, a single uniform conduit may be considered a conduit 118A/118B. In a second embodiment, the combination of conduit 118A, connection unit 120, and conduit 118B may be combined to form a single conduit.

In one embodiment, a motor 114 is positioned relative to heat exchange system 112 to power the operation of the heat exchange system 112. A fan 116 is positioned relative to the heat exchange system 112 to move air denoted as 132 within the housing or case 100 and expel the air 132 through and/or around the heat exchange system 112 to the outside of the housing or case 100 as denoted by air 134. It should be appreciated that the fan 116 may be positioned in a variety of locations including between the heat exchange system 112 and the housing or case 100. In addition, in one embodiment, air vents 130 may be disposed at various locations within the housing or case 100.

In one embodiment, liquid is circulated in the liquid cooling system depicted in FIG. 1 to dissipate heat from processor 104. In one embodiment, the liquid (i.e., cooled liquid, heated liquid, etc.) is a non-corrosive propylene glycol based coolant.

It should be appreciated that several two-piece liquid cooling systems are presented in the instant application. For example, heat transfer system 106 may be considered the first piece and heat exchange system 112 may be considered the second piece of a two-piece liquid cooling system. In another embodiment, heat transfer system 106 in combination with conduit 108A and conduit 118A may be considered the first piece of a two-piece liquid cooling system, and heat exchange system 112 in combination with conduit 108B and conduit 118B may be considered the second piece of a two-piece liquid cooling system. It should be appreciated that a number of elements of the liquid cooling system may be combined to deploy the liquid cooling system as a two-piece liquid cooling system. For example, the motor 114 may be combined with the heat exchange system 112 to produce one piece of a two-piece liquid cooling system.

During operation, cooled liquid as depicted by direction arrows 128 is transported in the conduit 118A/118B to the heat transfer system 106. The cooled coolant 128 in the conduit 118A/118B moves through a cavity in the heat transfer system 106 as shown by liquid direction arrow 122. In one embodiment, the heat transfer system 106 transfers and removes heat from the processor 104 to the liquid denoted by direction arrow 122. Heating the liquid in the heat transfer system 106 with the heat from the processor 104 transforms the cooled liquid 128 to heated liquid. It should be appreciated that the terms cooled liquid and heated liquid are relative terms as used in this application and represent a liquid that has been cooled and a liquid that has been heated, respectively. The heated liquid is then transported on conduits 108A/108B as depicted by directional arrows 124. In one embodiment of the present invention, the cooled liquid 128 enters the heat transfer system 106 at a lower point than the exit point for the heated liquid depicted by directional arrows 124. As a result, as the cooled liquid 128 is heated it becomes lighter and rises in the heat transfer system 106. This creates liquid movement, liquid momentum, and liquid circulation (i.e., convective liquid circulation) in the liquid cooling system.

The heated liquid 124 is transported through conduit 108A/108B to the heat exchange system 112. The heated liquid depicted by directional arrows 124 enters the heat exchange system 112 through conduit 108B. The heated liquid 124 has liquid momentum as a result of being heated and rising in the heat transfer system 106. It should be appreciated that the circulation of the heated liquid 124 is also aided by the pump assembly (not shown) associated with the heat exchange system 112. The heated liquid 124 then flows through the heat exchange system 112 as depicted by directional arrows 126. As the heated liquid 124 flows through the heat exchange system 112, the heated liquid 124 is cooled. As the heated liquid 124 is cooled, the heated liquid 124 becomes heavier and falls to the bottom of the heat exchange system 112. The cooler, heavier liquid falling to the bottom of the heat exchange system 112 also creates liquid movement, liquid momentum, and liquid circulation (i.e., convective liquid circulation) in the system. The cooled liquid 128 then exits the heat exchange system 112 through the conduit 118B.

As a result, in one embodiment of the present invention, liquid circulation is created by: (1) heating cooled liquid 128 in heat transfer system 106 and then (2) cooling heated liquid 124 in heat exchange system 112. In both scenarios, liquid is introduced at a certain position in the heat transfer system 106 and the heat exchange system 112 to create the momentum (i.e., convective liquid circulation) resulting from heating and cooling of the liquid. For example, in one embodiment, cooled liquid 128 is introduced in the heat transfer system 106 at a position that is below the position that the heated liquid 124 exits the heat transfer system 106. Therefore, conduit 118A, which transports cooled liquid 128 to heat transfer system 106 is positioned below conduit 108A which transports the heated liquid 124 away from the heat transfer system 106. As a result, after the cooled liquid 128 transported and introduced into the heat transfer system 106 by conduit 118A is transformed to heated liquid 124, the lighter heated liquid 124 rises in the heat transfer system 106 and exits through conduit 108A which is positioned above conduit 118A. In one embodiment, positioning conduit 108A above conduit 118A enables conduit 108A to receive and transport the lighter-heated liquid 124, which rises in the heat transfer system 106.

A similar scenario occurs with the heat exchange system 112. The conduit 108B, which transports the heated liquid 124, is positioned above the conduit 118B, which transports the cooled liquid 128. For example, in one embodiment, conduit 108B is positioned at the top portion of the heat exchange system 112. Therefore, heated liquid 124 is introduced into the top of the heat exchange system 112. As the heated liquid 124 cools in heat exchange system 112, the heated liquid 124 becomes heavier and falls to the bottom of heat exchange system 112. A conduit 118B is then positioned at the bottom of the heat exchange system 112 to receive and transport the cooled liquid 128.

In addition to the convective liquid circulation occurring as a result of the positioning of inlet and outlet points in the heat transfer system 106 and the heat exchange system 112, a pump (not shown in FIG. 1) is also used to circulate liquid within the liquid cooling system. For the purposes of discussion, the liquid circulation resulting from the use of power (i.e., the pump) may be called forced circulation. Therefore, processor heat dissipation is accomplished using convective liquid circulation and forced circulation.

In addition to circulating liquid within the liquid cooling system, a fan 116 is used to move air across, around, and through the heat exchange system 112. In one embodiment, the fan 116 is positioned to move air through and around the heat exchange system 112 to create substantial additional liquid cooling with the heat exchange system 112. In another embodiment, air (i.e., depicted by 132) heated within the housing or case 100 is expelled outside of the housing or case 100 as depicted by 134 to provide additional heat dissipation.

In one embodiment, each of the methods, such as convective liquid circulation, forced liquid circulation, delivering air through the heat exchange system 112, and expelling air from within the housing or case 100, may each be used separately or in combination. As each technique is combined or added in combination, an exponentially increasing amount of heat dissipation is achieved.

FIG. 2 displays a sectional view of a heat exchange system implemented in accordance with the teachings of the present invention. FIG. 2 displays a sectional view of heat exchange system 112 having no reservoir along section line 140 shown in FIG. 1. A cross section of the motor 114 is shown. The motor 114 is positioned above heat exchange system 112; however, the motor 114 may be positioned on the sides or on the bottom of heat exchange system 112. Further, heat exchange system 112 may be deployed without the motor 114 and derive power from another location in the system.

Heat exchange system 112 includes an input cavity 200, a heat dissipater 210, and an output cavity 212. In one embodiment, the motor 114 is connected through a shaft 202 to an impeller 216, disposed in an impeller case 214. In one embodiment, the input cavity 200 is connected to the conduit 108B. In another embodiment, an impeller case 214, an impeller casing input 220, and an impeller exhaust 218 are positioned within the output cavity 212. The impeller exhaust 218 is connected to the conduit 118B. Further, in one embodiment, liquid tubes 208 run through the length of the heat dissipater 210 and transport liquid from the input cavity 200 to the output cavity 212. In yet another embodiment, heat exchange system 112 may be fitted with a snap-in unit for easy connection as a single unit within or to housing or case 100 of FIG. 1. In all of the above embodiments, there is no reservoir employed or used in the cooling system.

In one embodiment, the input cavity 200, the heat dissipater 210, and the output cavity 212 may be made from metal, metallic compounds, plastics, or any other materials that would optimize the system for a particular application. In one embodiment, the input cavity 200 and the output cavity 212 are connected to the heat dissipater 210 using solder, adhesives, or a mechanical attachment. In another embodiment, the heat dissipater 210 is made from copper. In yet another embodiment, the heat dissipater 210 could be made from aluminum or other suitable thermally conductive materials. For example, the fin units 204 may be made from copper, aluminum, or other suitable thermally conductive materials.

Although straight liquid tubes 208 are shown in FIG. 2, serpentine, bending, and flexible liquid tubes 208 are contemplated and within the scope of the present invention. In one embodiment, the liquid tubes 208 may be made from metal, metallic compounds, plastics, or any other materials that would optimize the system for a particular application. The liquid tubes 208 are opened on both sides to receive heated liquid from the input cavity 200 and to output cooled liquid to the output cavity 212. In one embodiment, the liquid tubes 208 are designed to encourage non-laminar flow of liquid in the tubes. As such, more effectively cooling of the liquid is accomplished.

In one embodiment, a shaft 202 runs through the input cavity 200, through the heat dissipater 210 (i.e., through a liquid tube 208), to the output cavity 212. It should be appreciated that the shaft 202 may be made from a variety of materials, such as metal, metallic compounds, plastics, or any other materials that would optimize the system for a particular application.

The heat dissipater 210 includes a plurality of liquid tubes 208 and fin units 204 including fins 206. The liquid tubes 208, fin units 204, and fins 206 may each vary in number, size, and orientation. For example, the fins 206 maybe straight as displayed in FIG. 2, bent into an arch, etc. In addition, fins 206 may be implemented with a variety of angular bends, such as 45-degree angular bends. Further, the fins 206 are arranged to produce non-laminar flow of the air stream as the air denoted as 132 of FIG. 1 transition through the fins 206 to the air denoted by 134 of FIG. 1.

The motor 114 is positioned on one end of the shaft 202 and an impeller 216 is positioned on an oppositely disposed end of the shaft 202. In one embodiment, the motor 114 may be implemented with a brushless direct current motor; however, other types of motors, such as AC induction, AC, or DC servo-motors, may be used. Further, different types of motors that are capable of operating a pump are contemplated and are within the scope of the present invention.

In one embodiment, the pump is implemented with an impeller 216. However, it should be appreciated that other types of pumps may be deployed and are in the scope of the present invention. For example, inline pumps, positive displacement pumps, caterpillar pumps, and submerged pumps are contemplated and within the scope of the present invention. The impeller 216 is positioned within an impeller case 214. In one embodiment, the impeller 216 and the impeller case 214 are positioned in an output cavity 212. However, it should be appreciated that in an alternate embodiment, the impeller 216 and the impeller case 214 may be positioned outside of the output cavity 212 at another point in the liquid cooling system. In a second embodiment, the pump is deployed at the bottom of the output cavity 212 and as such is self-priming.

During operation, heated liquid is received in the input cavity 200 from the conduit 108B. The heated liquid is distributed across the liquid tubes 208 and flow through the liquid tubes 208. As the heated liquid flows through the liquid tubes 208, the heated liquid is cooled by the fin units 204 that transform the heated liquid into cooled liquid. The cooled liquid is then deposited in the output cavity 212 from the liquid tubes 208. As the shaft 202 rotates, the impeller 216 operates and draws the cooled liquid into the impeller case 214. The cooled liquid is then transported out of the impeller case 214 and into the conduit 118B by the impeller 216.

It should be appreciated that in one embodiment of the present invention, the conduit 108B is positioned above the heat dissipater 210 and above the output cavity 212. As such, as the heated liquid received in input cavity 200 flows through the heat dissipater 210, the heated liquid is transformed into cooled liquid, which is heavier than the heated liquid. The heavier-cooled liquid then falls to the bottom of the heat dissipater 210 and is deposited in the output cavity 212. The heavier-cooled liquid is output through the conduit 118B using the impeller 216. In addition, in an alternate embodiment, when the impeller 216 is not operating, the movement of the heavier-cooled liquid generates momentum (i.e., convective liquid circulation) in the liquid cooling system of FIG. 1 as the cooled liquid moves from the input cavity 200, through the heat dissipater 210 to the output cavity 212.

In one embodiment, air flows over the fin 204 and through the fins 206 to provide additional cooling of liquid flowing through the liquid tubes 208. For example, using FIG. 1 in combination with FIG. 2, air is generated by fan 116 and flows through the fin units 204 and fins 206 to provide additional cooling by cooling both the fin units 204 and the liquid flowing in the liquid tubes 208.

FIG. 3 displays a system view of an embodiment of a liquid cooling system disposed in a housing and implemented in accordance with the teachings of the present invention. A data processing and liquid cooling system is depicted. The data processing and liquid cooling system comprises a housing 300 (e.g., a computer cabinet or case) and a processor 302 (e.g., a processing unit, CPU, microprocessor) disposed within housing 305. The data processing and liquid cooling system 300 further comprises a heat transfer system 304 engaged with one or more surfaces of a processor 302, a transport system 307, and a heat exchange system 310. It should be appreciated that a variety of heat transfer systems 304 implemented in accordance with the teachings of the present invention may be used as heat transfer system 304.

A liquid coolant is circulated through heat transfer system 304 as indicated by flow indicators 301 and by transport system 307. Transport system 307 delivers cooled liquid from and returns heated liquid to heat exchange system 310.

More specifically, as the processor 302 functions, it generates heat. In the case of a typical processor 302, the heat generated can easily reach destructive levels. This heat is typically generated at a rate of a certain amount of BTU per second. Heating usually starts at ambient temperature and continues to rise until reaching a maximum. When the machine is turned off, the heat from processor 302 will peak to an even higher maximum. This temperature peak can be so high that a processor 302 will fail. This failure may be permanent or temporary. With the present invention, this temperature peak is virtually eliminated. Operation at higher system speeds will amplify this effect even more. With the present invention, however, processor 302 is cooled to within a few degrees of room temperature. In addition, processor 302 will remain within a few degrees of ambient temperature after system shut down.

Depending upon specific design constraints and criteria, heat transfer system 304 may be coupled to processor 302 in a number of ways. As depicted, heat transfer system 304 is engaged with the top surface of processor 302. This contact may be established using, for example, a thermal epoxy, a dielectric compound, or any other suitable contrivance that provides direct and thorough transfer of heat from the surface of processor 302 to the heat transfer system 304. A thermal epoxy may be used to facilitate the contact between processor 302 and heat transfer system 304. Optionally, the epoxy may have metal casing disposed within to provide better heat removal. Alternatively, a silicon dielectric may be utilized. Alternatively, mechanical fasteners (e.g., clamps or brackets) may be used, alone or in conjunction with epoxy or dielectric, to adjoin the units in direct contact. Other methods can be used or a combination of the methods can be used. Further, it should be appreciated that the heat transfer system 304 may be attached to any part of the processor 302 and still remain within the scope of the present invention.

In an embodiment, cooling system 300 represents an application of the present invention in larger data processing systems, such as personal computers or server equipment. Heat exchange system 310 comprises a coolant reservoir 314 and a heat exchange system 330 coupled together by liquid conduit 328. Liquid cooling system 300 further comprises conduit 308, which couples coolant reservoir 314 to transfer system 304. Liquid cooling system 300 further comprises conduit 306, which couples heat exchange system 310 to the heat transfer system 304. Conduit 308 transports cooled liquid 320 from coolant reservoir 314 to the heat transfer system 304. Liquid conduit 306 receives and transfers heated liquid from the heat transfer system 304 to heat exchange system 310. Conduit 328 transports cooled liquid from heat exchange system 330 back to coolant reservoir 314. Conduits 306, 308, and 328 may comprise a number of suitable rigid, semi-rigid, or flexible materials (e.g., copper tubing, metallic flex tubing, or plastic tubing)depending upon desired cost and performance characteristics. Conduits 306, 308, and 328 may be inter-coupled or joined with other system components using any appropriate permanent or temporary contrivances (e.g., such as soldering, adhesives, or mechanical clamps).

Coolant reservoir 314 receives and stores cooled liquid 320 from conduit 328. Cooled liquid 320 is a non-corrosive, low-toxicity liquid, resilient and resistant to chemical breakdown after repeated usage while providing efficient heat transfer and protection against corrosion. Depending upon particular cost and design criteria, a number of gases and liquids may be utilized in accordance with the present invention (e.g., propylene glycol). Coolant reservoir 314 is a sealed structure appropriately adapted to house conduits 328 and 308. Coolant reservoir 314 is also adapted to house a pump assembly 316. Pump assembly 316 may comprise a pump motor 312 disposed upon an upper surface of coolant reservoir 314 and an impeller assembly 324 which extends from the pump motor 312 to the bottom portion of coolant reservoir 314 and into cooled liquid 320 stored therein. The portion of delivery conduit 308 within coolant reservoir 314 and pump assembly 316 are adapted to pump cooled liquid 320 from coolant 314 reservoir into and along conduit 308. In one embodiment, pump assembly 316 includes a motor 312, a shaft 322 and an impeller 324. Conduit 308 may be directly coupled to pump assembly 316 to satisfy this relationship or conduit 308 may be disposed proximal to impeller assembly 324 such that the desired pumping is effected.

Heat exchange system 330 receives heated liquid via conduit 306. Heat exchange system 330 may be formed or assembled from a suitable thermal conductive material (e.g., brass or copper). Heat exchange system 330 comprises one or more chambers, coupled through a liquid path (e.g., heat dissipater 332 consisting of canals, tubes). Heated liquid is received from conduit 306 and transported through heat exchange system 330 leaving heat exchange system 330 through conduit 328. The liquid flows through the chambers of heat exchange system 330 thereby transferring heat from the liquid to the walls of heat exchange system 330 may further comprise one or more heat dissipaters 332 to enhance heat transfer from the liquid as it flows through heat dissipater 332 disposed in heat exchange system 330. Heat dissipater 332 comprises a structure appropriate to effect the desired heat transfer (e.g., rippled fins). In one embodiment, an attachment mechanism 334 connects heat transfer system (310 & 330) to casing 305 for further dissipation of heat. A more thorough discussion of the liquid cooling system 300 depicted in FIG. 3 may be derived from U.S. Pat. No. 6,529,376, entitled "System Processor Heat Dissipation," issued on Mar. 4, 2003, which is herein incorporated by reference.

Figure 4A:
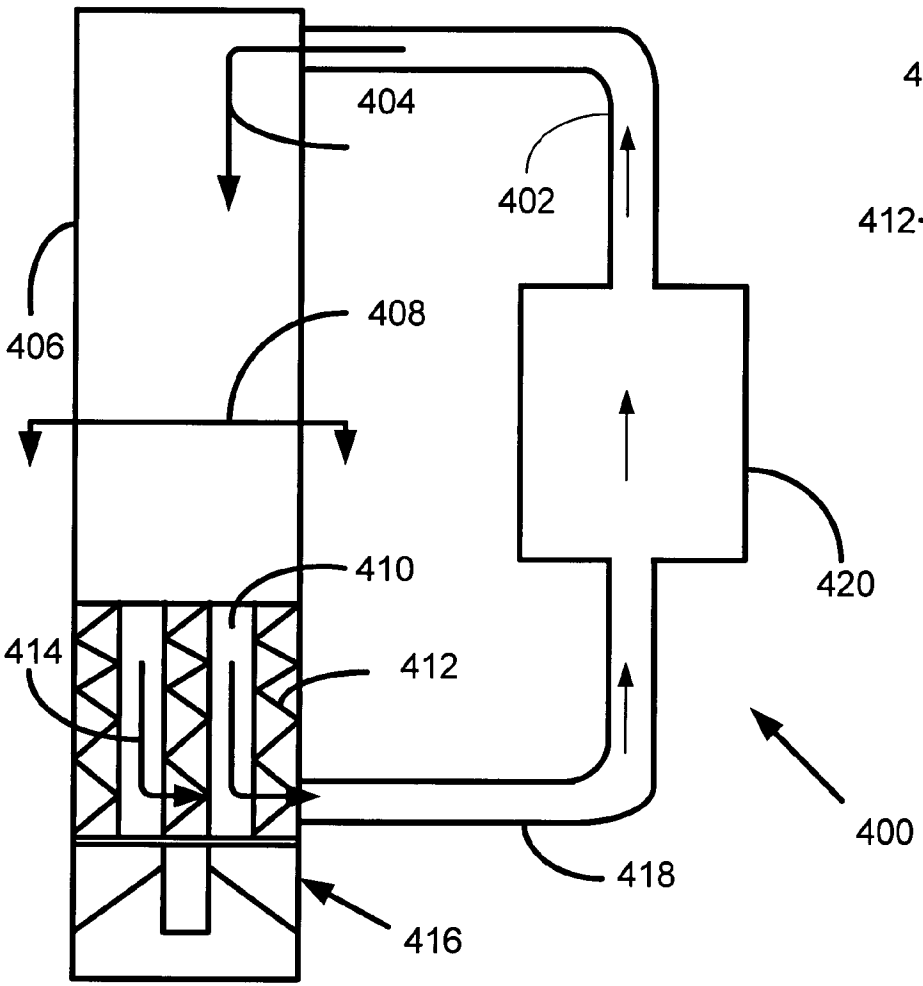
FIG. 4A displays a system view of a liquid cooling system suitable for use in a mobile computing environment, such as a laptop, and implemented in accordance with the teachings of the present invention.
Figure 5:
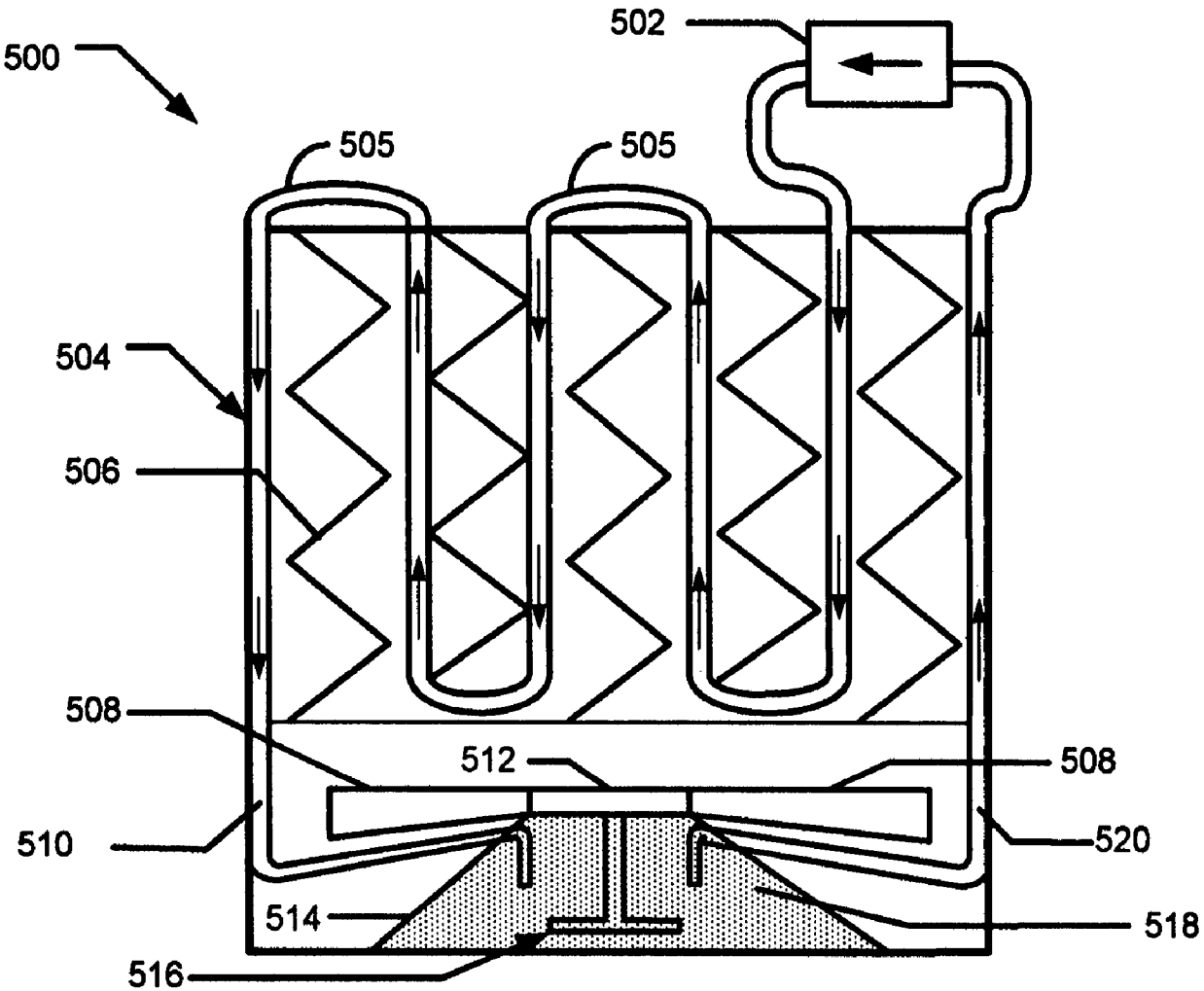
FIG. 5 displays a system view of another liquid cooling system suitable for use in a mobile computing system, such as a Personal Data Assistant (PDA), and implemented in accordance with the teachings of the present invention.

FIG. 4A displays a system view of a liquid cooling system suitable for use in a mobile computing environment, such as a laptop, and implemented in accordance with the teachings of the present invention. The material, selection, and scale of the elements of liquid cooling system 400 are adjusted according to the particular cost size and performance criteria of the particular application. A heat transfer system is shown as 420, such as the heat transfer system shown as 800 in FIGS. 8A and 8B, which both include a housing 802 and a motor deployed in the housing 802, such as motor 806. The heat transfer system 420 is coupled to the heat exchange system 406 by conduits 402 and 418.

Conduit 418 transports cooled liquid 414 from the heat exchange system 406 to the heat transfer system 420. Conduit 402 receives and transfers heated liquid from the heat transfer system 420 and transfers the heated liquid shown as 404 to the heat exchange system 406. In one embodiment, conduit 402 and conduit 418 may comprise a number suitable rigid, semi-rigid, or flexible materials. (e.g., copper tubing, metal flex tubing, or plastic tubing) depending on desired costs and performance characteristics required. Conduit 402 and conduit 418 may be inter-coupled or joined with other system components using any appropriate permanent or temporary connection mechanism, such as soldering, adhesives, mechanical clamps, or any combination thereof.

Heat transfer system 420 includes a cavity (not shown in FIG. 4A). Heat transfer system 420 receives cooled liquid from conduit 418. The cooled liquid is a non-corrosive, low-toxicity liquid, resilient and resistant to chemical breakdown after repeated usage while providing efficient heat transfer. Depending upon particular cost and design criteria, a number of gases and liquids may be utilized in accordance with the present invention (e.g., propylene glycol).

During operation, the fan 416 blows air over the fins 412. The air keeps the fins 412 cool which in turn cool the liquid in liquid flow tubes 410. A pump (not shown in FIG. 4A) disposed in the heat transfer system 420 drives liquid around in the system. Cooled liquid enters the heat transfer system 420 and heated liquid exits the heat transfer system 420. A conduit 402 transfers the heated liquid shown as 404 to heat exchange system 406. The heated liquid flows through the liquid flow tubes 410 and is cooled by the fins 412 and the air flowing from the fan 416. Cooled liquid 414 then exits the heat exchange system 406 and is conveyed on conduit 418 to the heat transfer system 420.

FIG. 4B displays a cross-sectional view of heat exchange system 406 along sectional lines 408 of FIG. 4A. In FIG. 4B, the liquid flow tubes 410 are shown surrounded by the fins 412. It should be appreciated that the fins 412 may be deployed in a variety of different configurations and still remain within the scope of the present invention.

FIG. 5 displays a system view of another liquid cooling system suitable for use in a mobile computing system, such as a Personal Data Assistant (PDA), and implemented in accordance with the teachings of the present invention. Liquid cooling system 500 represents an application of the present invention in smaller handheld applications, such as palmtop computers, cell phones, or PDAs. The material selection and scale of the elements of liquid cooling system 500 are adjusted according to the particular cost, size, and performance criteria of the particular application. Liquid cooling system 500 includes a heat transfer system 502 and a heat exchange system 504. Cooled liquid is communicated from the heat exchange system 504 to the heat transfer system 502 through a conduit 520. Heated liquid is transferred from the heat transfer system 502 to the heat exchange system 504 through the conduit 510.

The heat exchange system 504 includes liquid flow tubes 505 for conveying and cooling liquid. Fins 506 are interspersed between the liquid flow tubes 505. However, it should be appreciated that a variety of configurations may be implemented and still remain within the scope of the present invention. For example, the liquid flow tubes 505 may take a variety of horizontal, vertical, and serpentine configurations. In addition, the fins 506 may be deployed as vertical fins, horizontal fins, etc. Lastly, the fins 506 and liquid flow tubes 505 may be deployed relative to each other, in a manner that maximizes cooling of liquid flowing through the liquid flow tubes 505.

In one embodiment, the fins 506 in combination with the liquid flow tubes 505 may be considered a heat dissipater. In another embodiment, the fins 506 may be considered a heat dissipater. Yet in another embodiment, the liquid flow tubes 505 positioned to receive air flowing over the liquid flow tubes 505 may be considered a heat dissipater.

A motor 512 is also positioned in the heat exchange system 504. The motor 512 and the cavity 514 form a sealed cavity for liquid 518. The motor 512 is connected to an impeller 516, which is deployed in the cavity 514. In one embodiment, the motor 512 in combination with the impeller 516 is considered a pump. In another embodiment, the impeller 516 is considered a pump. Conduit 510 brings cooled liquid into the cavity 514 and conduit 520 removes the cooled liquid from the cavity 514.

Conduits 510 and 520 may comprise a number of suitable rigid, semi-rigid, or flexible materials (e.g., copper tubing, metallic flex tubing, or plastic tubing) depending upon desired cost and performance characteristics. Conduits 510 and 520 may be incorporated or joined with other system components using any appropriate permanent or temporary contrivances (e.g., such as soldering, adhesives, mechanical clamps, or any combination thereof).

Cavity 514,which acts as a reservoir, receives and stores cooled liquid. Liquid 518 is a non-corrosive, low-toxicity liquid, resilient and resistant to chemical breakdown after repeated usage while providing efficient heat transfer and corrosion prevention. Depending upon particular cost and design criteria, a number of gases and liquids may be utilized in accordance with the present invention (e.g., propylene glycol). Cavity 514 is a sealed structure appropriately adapted to house conduits 510 and 520.

Depending upon a particular application, liquid cooling system 500 may further comprise one or more airflow elements 508 disposed within liquid cooling system 500 to effect desired heat transfer. As depicted, airflow elements 508 may comprise fan blades coupled to motor 512, adapted to provide air circulation as motor 512 operates. Alternatively, liquid cooling system 500 may comprise separate airflows assemblies disposed and adapted to provide or facilitate an airflow that enhances desired heat transfer.

During operation, motor 512 operates and airflow elements 508 revolve. The revolving airflow elements 508 affect airflow through the heat exchange system 504 and cool the fins 506. In addition, the airflow cools the liquid 518 in the cavity 514. In one embodiment, the airflow elements 508 produce airflow that is directed over liquid flow tubes 505, fins 506, and cavity 514. The motor 512 also drives impeller 516, which performs an intake function, and transfers cooled liquid 518 through conduit 520 to the heat transfer system 502. The cooled liquid 518 is heated in heat transfer system 502 and transferred to heat exchange system 504. As the heated liquid flows through liquid flow tubes 505, the heated liquid is cooled and becomes cooled liquid as a result of the airflow on the fins 506 and the airflow over the liquid flow tubes 505.

Although the heat transfer system 502 is positioned in a specific orientation in FIG. 5, in one embodiment of the present invention, the heat transfer system 502 is positioned so that cooled air comes into the bottom of heat transfer system 502 and heated air exits through the top of heat transfer system 502.

Figure 6:
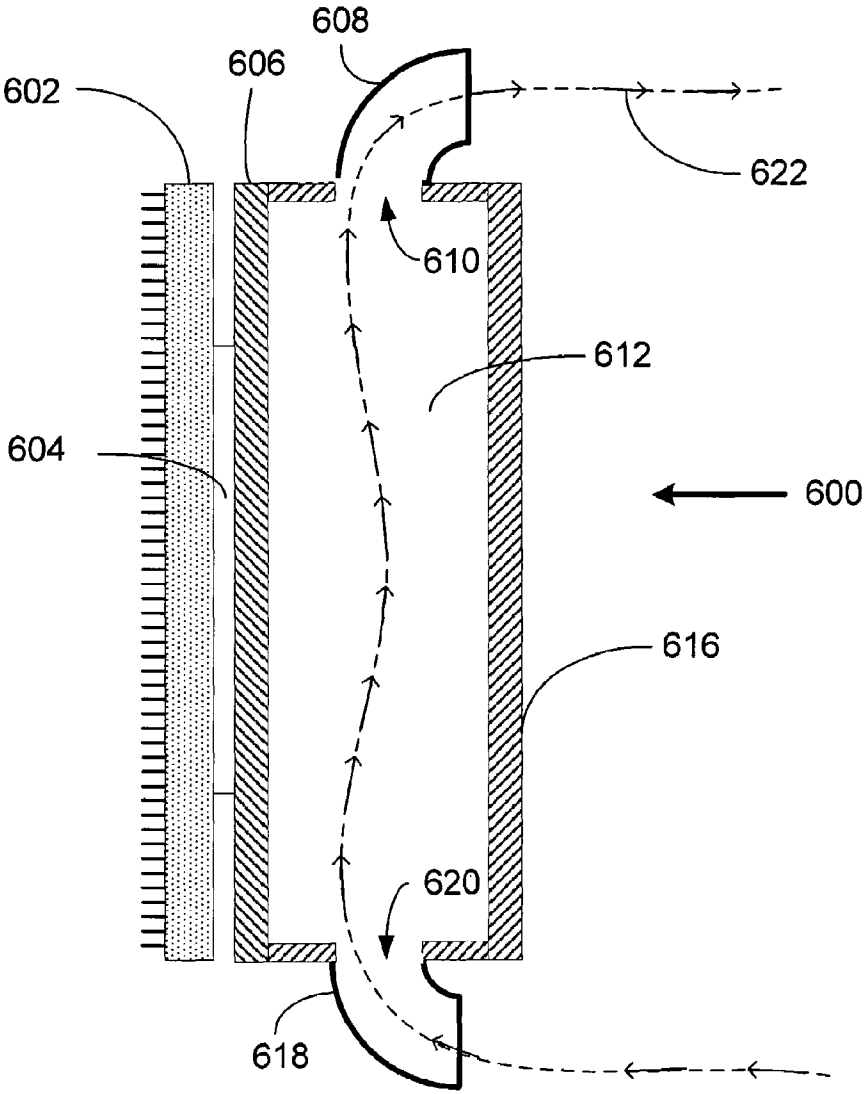
FIG. 6 displays a sectional view of an embodiment of a heat transfer system implemented in accordance with the teachings of the present invention.

FIG. 6 displays a sectional view of an embodiment of a heat transfer system implemented in accordance with the teachings of the present invention. It should be appreciated that the heat transfer system 600 may be used with the liquid cooling system depicted in FIGS. 1 through 5.

A housing 616 includes a heat sink 606 formed within the housing 616. The housing 616 may be manufactured from a suitable conductive or thermally insulating material. For example, materials, such as copper and various plastics, may be used. The housing 616 includes a cavity 612. Cooled liquid is brought into the cavity 612 through a conduit 618 and out of the cavity 612 through a conduit 608. The liquid enters the cavity 612 through an inlet 620 and exits the cavity 612 through the outlet 610 as defined by flow path 622. A processor 602 is coupled to the heat sink 606 through packaging material 604.

In one embodiment, the processor 604 is connected to the packaging material 606 through a contact medium. In one embodiment, the contact medium is implemented with an epoxy. In another embodiment, the contact medium may be implemented with heat transfer pads, adhesives, thermal paste, etc.

In one embodiment, cooled liquid is transported to the heat transfer system 600 through conduit 618. At the inlet 620, cooled liquid enters the heat transfer system 600. Heat is transported from processor 602 through packaging material 604 to the liquid housed in cavity 612. The cooled liquid, which enters the cavity 612, is heated by the heat transferred from the processor 602. As the cooled liquid is heated, the cooled liquid is transformed into heated liquid. Since heated liquid is lighter than the cooled liquid, the heated liquid rises in cavity 612. At the outlet 610, the lighter-heated liquid is positioned to exit the cavity 612. The lighter-heated liquid then exits the cavity 612 through the conduit 608. Consequently, after cooled liquid enters the cavity 612 at inlet 620 and is heated in the cavity 612, the heated liquid becomes lighter, rises, and exits the cavity 612 at a point denoted by outlet 610. In one embodiment, the inlet 620, which receives the cooled liquid, is positioned below the outlet 610 where the heated liquid exits the cavity 612. In another embodiment, the inlet 620 and the outlet 610 may be repositioned in the housing 616 once the inlet 620 is positioned below the outlet 610.

Figure 7A:
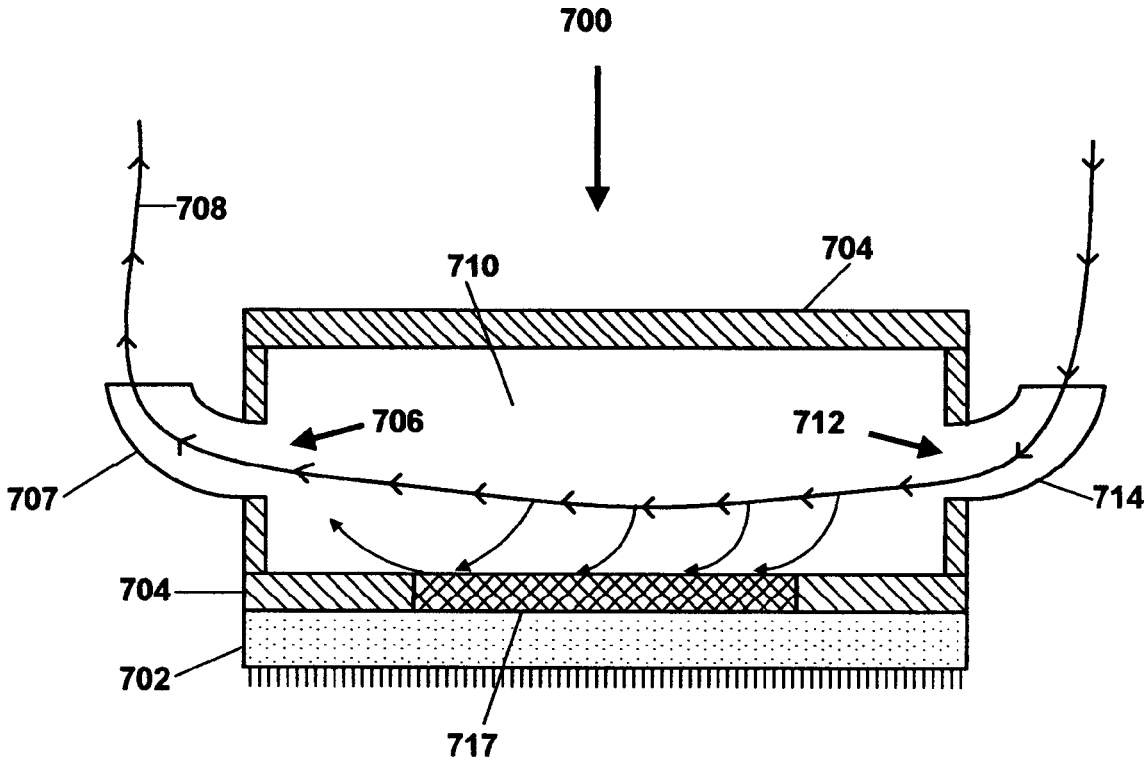
FIG. 7A displays a sectional view of an embodiment of a direct-exposure heat transfer system implemented in accordance with the teachings of the present invention.

FIG. 7A displays a sectional view of an embodiment of a direct-exposure heat transfer system implemented in accordance with the teachings of the present invention. It should be appreciated that the heat transfer system 700 may be used with the liquid cooling system depicted in FIGS. 1 through 5.

A processor 702 is connected through packaging material 717 to a housing 704 of heat transfer system 700. In one embodiment, packaging material 717 may be any type of packaging material used to protect or package a semiconductor and/or processor. The housing 704 may be manufactured from a suitable conductive or thermally insulating material. For example, materials, such as copper and various plastics, may be used. The housing 704 is connected to the packaging material 717 through a variety of connection mechanisms, such as by clamping, adhesives, thermal paste socket fixtures, etc. Housing 704 is mated to packaging material 717 to form a cavity 710, which provides a liquid pathway (i.e., conduit) for liquid as shown by liquid flow path 708. The housing 704 includes an inlet 712, which provides an opening for liquid to enter cavity 710 and an outlet 706, which provides an opening or exit point for liquid to exit the cavity 710.

In one embodiment, cooled liquid is transported to the heat transfer system 700 through conduit 714. At the inlet 712, cooled liquid enters the cavity 710 of the heat transfer system 700. The liquid flows over the packaging material 717 and is in direct contact with the packaging material 717. Heat is transported from processor 702 through the packaging material 717 to the liquid flowing through the cavity 710. The cooled liquid, which enters the cavity 710 and is in direct contact with the packaging material 717, is heated by the heat transferred through the packaging material 717 from the processor 702. As the cooled liquid is heated, the cooled liquid is transformed into heated liquid. Since heated liquid is lighter than the cooled liquid, the heated liquid rises in cavity 710. The lighter-heated liquid rises in the cavity 710 and exits at the outlet 706. The lighter-heated liquid is then transported on conduit 707. Consequently, after cooled liquid enters the cavity 710 at inlet 712 and is heated in the cavity 710, the heated liquid becomes lighter, rises, and exits the cavity 710 at a point denoted by outlet 706. In one embodiment, the inlet 712, which receives the cooled liquid, is positioned below the outlet 706 where the heated liquid exits the cavity 710. In another embodiment, the inlet 712 and the outlet 706 may be repositioned in the housing 704 once the inlet 712 is positioned below the outlet 706.

The mating of the packaging material 717 and the housing 704 to form the cavity 710 enables the liquid to directly contact the packaging material 717. The cavity 710 serves as a conduit or flow path for liquid as shown by liquid flow path 708. As the liquid traverses along the liquid flow path 708, the liquid flows across the packaging material 717. As the liquid flows across the packaging material 717, the heat generated by the processor 702 and transferred through the packaging material 717 is absorbed by the liquid flowing across the packaging material 717. The absorption of the heat by the liquid also results in the dissipation of the heat from the processor 702. As the liquid absorbs the heat, the liquid becomes heated liquid and rises in the cavity 710. In addition, as cooled liquid is introduced in the cavity 710 through inlet 712, the heated liquid is pushed toward the outlet 706. Therefore, a continual stream of cooled liquid is introduced into the cavity 710, heated, and then pushed out of the cavity 710.

Figure 7B:
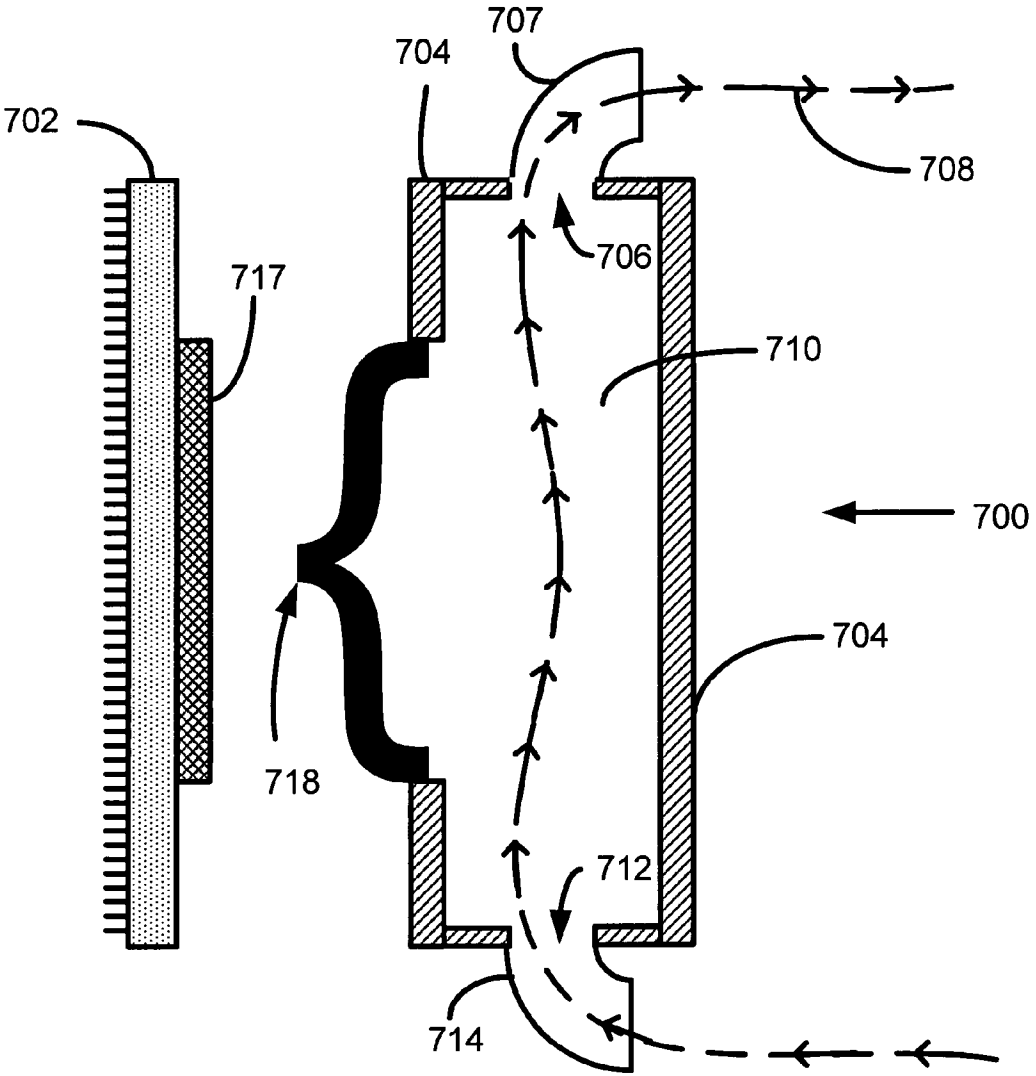
FIG. 7B displays an exploded view of the direct-exposure heat transfer system depicted in FIG. 7A.

FIG. 7B displays an exploded view of the direct-exposure heat transfer system depicted in FIG. 7A. A processor 702 is connected through packaging material 717 to a housing 704 of heat transfer system 700.

The housing 704 is connected to the packaging material 717 through a variety of mechanisms, such as by clamping, adhesives, thermal paste socket fixtures, etc. Housing 704 is mated to packaging material 717 to form a cavity 710. In one embodiment, the packaging material 717 is mated to a receptacle shown as 718, which is formed in the body of the housing 704. In another embodiment, the packaging material 717 is attached to the housing 704 through receptacle 718 to form a cavity 710. In one embodiment, the receptacle 718 may include an opening in housing 704 for mating with packaging material 717. In another embodiment, receptacle 718 may include any additional fixtures, clips, connectors, adhesive, etc. used to mate packaging material 717 to the receptacle 718.

The housing 704 includes an inlet 712, which provides an input for liquid to enter cavity 710 and an outlet 706, which provides an opening for liquid to exit the cavity 710.

After connecting the packaging material 717 to the housing 704, a cavity 710 is formed. The packaging material 717 is mated with the receptacle 718 so that the liquid is contained in the cavity 710. The cavity 710 includes the inlet 712 and the outlet 706. The packaging material 717 is introduced into the cavity 710 such that when liquid flows through the cavity 710, the liquid will be in direct contact with the packaging material 717.

In one embodiment, cooled liquid is transported to the heat transfer system 700 through conduit 714. At the inlet 712, cooled liquid enters the heat transfer system 700. Liquid flows over the packaging material 717 and is in direct contact with the packaging material 717. Heat is transported from processor 702 through packaging material 717 to the liquid flowing through the cavity 710. The cooled liquid, which enters the cavity 710 and is in direct contact with the packaging material 717, is heated by the heat transferred from the processor 702 through the packaging material 717. As the cooled liquid is heated, the cooled liquid is transformed into heated liquid. Since heated liquid is lighter than the cooled liquid, the heated liquid rises in cavity 710. At the outlet 706, the lighter, heated liquid is positioned to exit the cavity 710. The lighter, heated liquid then exits the cavity 710 through the conduit 707. Consequently, after cooled liquid enters the cavity 710 at inlet 712 and is heated in the cavity 710, the heated liquid becomes lighter, rises, and exits the cavity 710 at a point denoted by outlet 706. In one embodiment, the inlet 712, which receives the cooled liquid, is positioned below the outlet 706 where the heated liquid exits the cavity 710. In another embodiment, the inlet 712 and the outlet 706 may be repositioned in the housing 704 once the inlet 712 is positioned below the outlet 706.

Figure 8A:
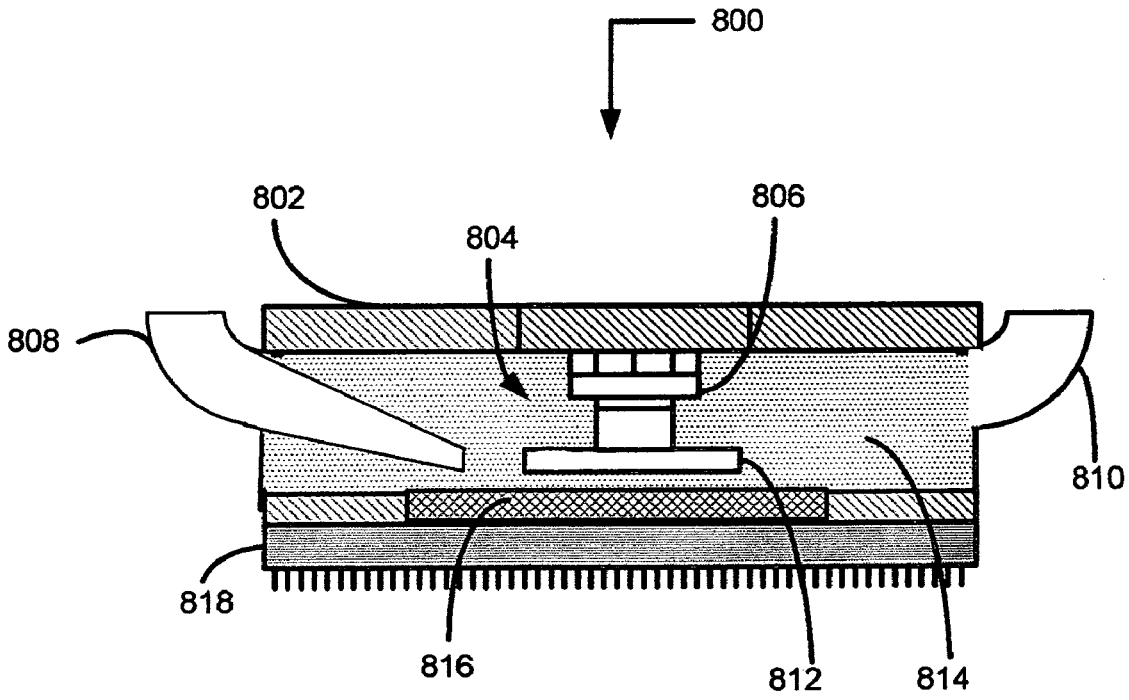
FIG. 8A displays a sectional view of an embodiment of a direct-exposure heat transfer system implemented in accordance with the teachings of the present invention.

FIG. 8A displays a sectional view of an embodiment of a direct-exposure heat transfer system implemented in accordance with the teachings of the present invention. FIG. 8A displays a heat transfer system 800 suitable for use as the heat transfer system 402 of FIG. 4. In addition, heat transfer system 800 may also be deployed in the liquid cooling systems shown in FIGS. 1 through 5. Packaging material 816 is coupled with housing 802 to form cavity 804. The cavity 804 is a sealed cavity that houses liquid 814. The liquid 814 enters the cavity 804 through conduit 810 and exits the cavity 804 through conduit 808. A motor 806 and an impeller 812 are deployed in the cavity 804. In another embodiment, the motor 806 may be deployed outside of the cavity 804. The packaging material 816 is coupled with a processor 818 that generates heat.

During operation, processor 818 generates heat. The heat is transmitted through packaging material 816. Cooled liquid flows from a heat exchange system, such as a heat exchange system shown in FIGS. 1 through 5 (not shown in FIG. 8A), into the cavity 804 through conduit 810. The cooled liquid directly engages the packaging material 816 and the heat is transferred from the packaging material 816 to the cooled liquid that entered the cavity 804. As the heat is transferred to the cooled liquid, the cooled liquid becomes heated liquid. The heated liquid is then sucked into the impeller 812 and then transported from the cavity 804 through the conduit 808.

The liquid 814 directly makes contact with the packaging material 816. As such, the heat is transferred from the processor 818 to the packaging material 816 and then finally to the liquid 814. The transfer of the heat from the processor 818 to the packaging material 816 and then finally to the liquid 814 has the effect of removing heat generated by the processor 818.

In one embodiment, the conduit 810 is positioned below the conduit 808. As such, when the heavier-cooled liquid enters the cavity 804 and is heated, the heavier-cooled liquid becomes lighter-heated liquid. The lighter-heated liquid rises in the cavity 804. Rising in the cavity 804 facilitates the exit of the lighter-heated liquid. For example, in one embodiment, the impeller 812 may be positioned toward the top of the cavity 804 to receive the lighter-heated liquid as it rises to the top of the cavity 804. The lighter-heated liquid is then sucked into the impeller 812 and transported through the conduit 808.

Figure 8B:
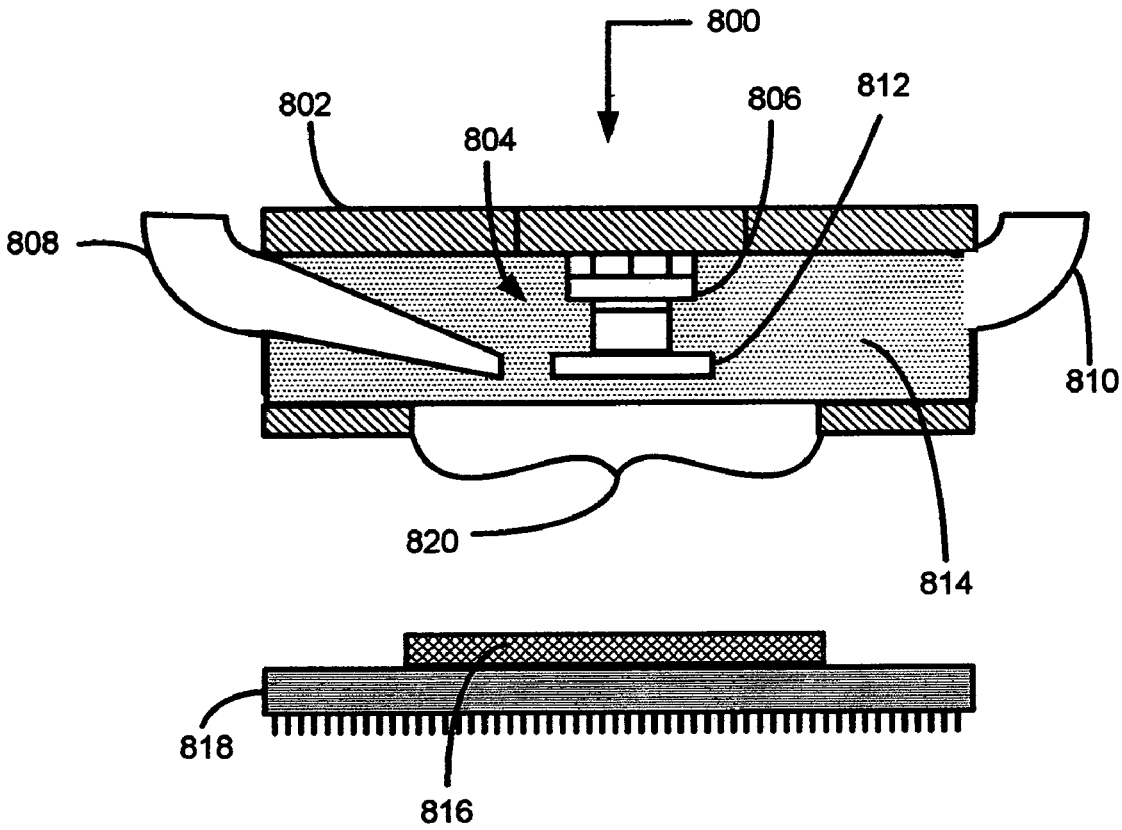
FIG. 8B displays a sectional view of an embodiment of a direct-exposure heat transfer system implemented in accordance with the teachings of the present invention.

FIG. 8B displays a sectional view of an embodiment of a direct-exposure heat transfer system implemented in accordance with the teachings of the present invention. FIG. 8B is an exploded view of FIG. 8A. Packaging material 816 is coupled with housing 802 to form cavity 804. The packaging material 816 is coupled to the housing 802 through a receptacle 820. The receptacle 820 may include an opening for receiving packaging material 816. The receptacle 820 may include connection devices for connecting packaging material 816 to housing 802 or the receptacle 820 may include adhesives for connecting packaging material 816 to the housing 802. It should be appreciated that a variety of coupling mechanisms may be used to connect the housing 802 to the packaging material 816 and may be considered a receptacle 820 as defined in the instant application.

The cavity 804 is a sealed cavity that houses liquid 814. The liquid 814 enters the cavity 804 through conduit 810 and exits the cavity 804 through conduit 808. A motor 806 and an impeller 812 are deployed in the cavity 804. In another embodiment, the motor 806 may be deployed outside of the cavity 804. The packaging material 816 is coupled with a processor 818 that generates heat.

During manufacturing, the packaging material 816 may be coupled to the housing 802 using a variety of procedures. The packaging material 816 is mated with the housing 802 to form a sealed cavity capable of storing liquid 814. During operation, processor 818 generates heat. The heat is transmitted through packaging material 816. Cooled liquid flows from a heat exchange system (not shown in FIG. 8A) into the cavity 804 through conduit 810. The cooled liquid directly engages the packaging material 816 and the heat is transferred from the packaging material 816 to the cooled liquid that entered the cavity 804. As the heat is transferred to the cooled liquid, the cooled liquid becomes heated liquid. The heated liquid is then sucked into the impeller 812 and then transported from the cavity 804 through the conduit 808.

The liquid 814 makes direct contact with the packaging material 816. As such, the heat is transferred from the processor 818 to the packaging material 816 and then finally to the liquid 814. The transfer of the heat from the processor 818 to the packaging material 816 and then finally to the liquid 814 has the effect of cooling the processor 818 or removing heat from the processor 818.

In one embodiment, the conduit 810 is positioned below the conduit 808. As such, when the heavier-cooled liquid enters the cavity 804 and is heated, the heavier-cooled liquid becomes lighter-heated liquid. The lighter-heated liquid rises in the cavity 804 and facilitates the exit of the lighter-heated liquid. For example, in one embodiment, the impeller 812 may be positioned toward the top of the cavity 804 to receive the lighter-heated liquid as it rises to the top of the cavity 804. The lighter-heated liquid is then sucked into the impeller 812 and transported through the conduit 808.

Figure 9:
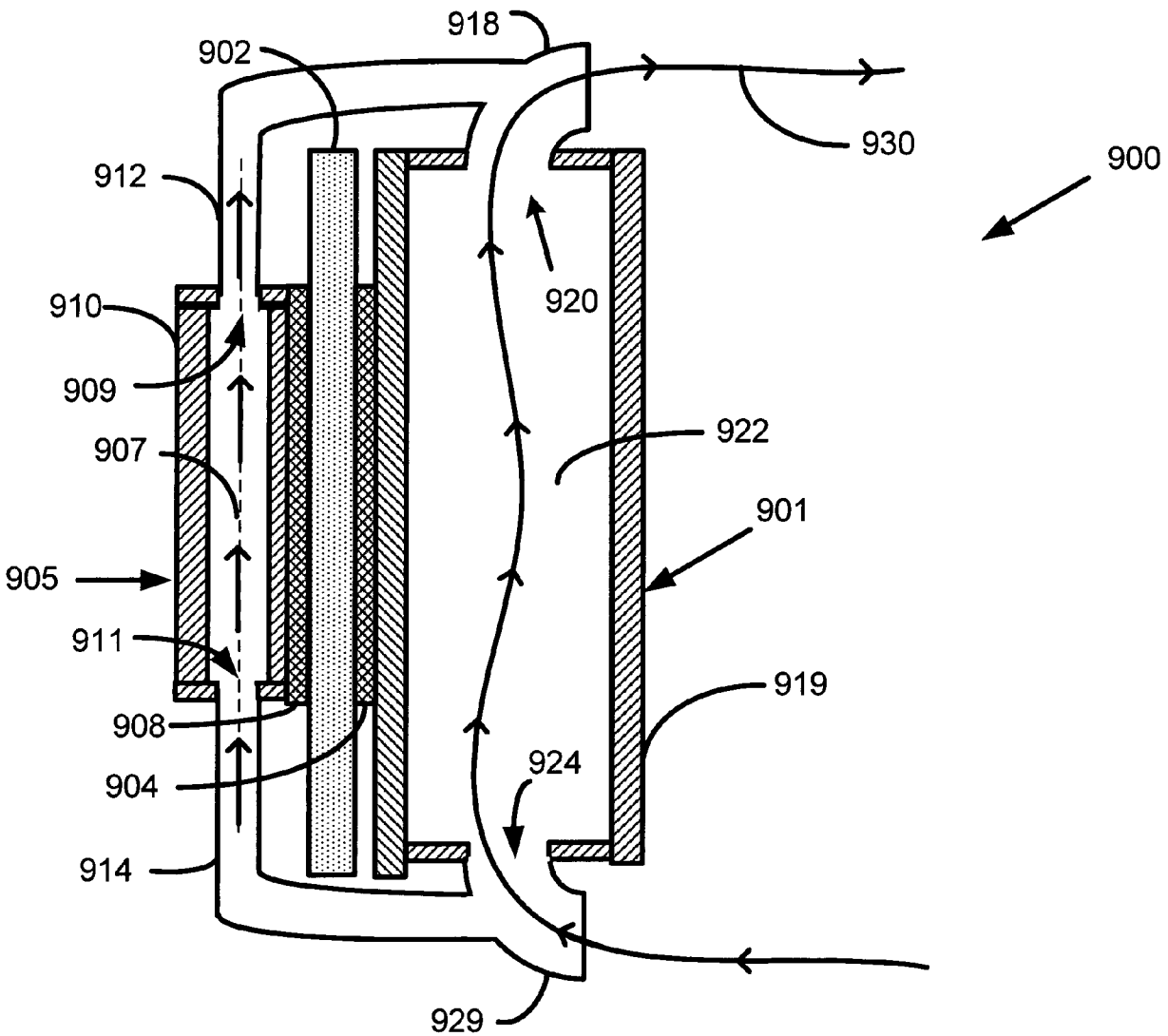
FIG. 9 displays a sectional view of an embodiment of a dual-surface heat transfer system implemented in accordance with the teachings of the present invention.

FIG. 9 displays a sectional view of an embodiment of a dual-surface heat transfer system implemented in accordance with the teachings of the present invention. It should be appreciated that the heat transfer system 900 may be used with the liquid cooling systems depicted in FIGS. 1 through 5.

The dual-surface heat transfer system 900 includes two heat transfer systems depicted as 901 and 905. Heat transfer system 901 includes a housing 919, which forms a cavity 922. The cavity 922 provides a flow path 930 (i.e., liquid pathway). The housing 919 includes an inlet 924, which provides an entry point for liquid to enter cavity 922, and an outlet 920, which provides an exit point for liquid to exit the cavity 922.

In one embodiment, cooled liquid is transported to the heat transfer system 900 through conduit 929. At the inlet 924, cooled liquid enters the heat transfer system 901. Heated liquid exits the cavity 922 at an outlet 920. The outlet 920 is connected to a conduit 918.

A processor 902 includes first packaging material 904 and second packaging material 908. In one embodiment, the processor 902 includes first packaging material 904 on one side of the processor 902 and second packaging material 908 on an oppositely disposed side of the processor 902 from the first packaging material 904. In another embodiment, the first packaging material 904 may be disposed on a first side of processor 902 and second packaging material 908 may be disposed on any second side of processor 902. The housing 919 engages the first packaging material 904.

A second heat transfer system 905 is shown. Heat transfer system 905 includes a housing 910, which forms a cavity 907. A cavity 907 provides a flow path (i.e., liquid pathway). The housing 910 includes an inlet 911, which provides an input for liquid to enter cavity 907 and an outlet 909, which provides an opening for liquid to exit the cavity 907.

In one embodiment, cooled liquid is transported to the heat transfer system 905 through a conduit 914. At the inlet 911, cooled liquid enters the heat transfer system 905. Heated liquid exits the cavity 907 at an outlet 909. The outlet 909 is connected to a conduit 912.

During operation, processor 902 produces heat, which is transferred through first packaging material 904 and second packaging material 908. As liquid flows through the cavity 922 and the cavity 907, the heat from the processor 902 is removed.

In one embodiment, cooled liquid is transported to the heat transfer system 905 through conduit 914. At the inlet 911, cooled liquid enters the heat transfer system 905. Heat is transported from processor 902 through second packaging material 908 to the liquid flowing through the cavity 907. As the cooled liquid is heated, the cooled liquid is transformed into heated liquid. Since heated liquid is lighter than the cooled liquid, the heated liquid rises in cavity 907. At the outlet 909, the lighter-heated liquid is positioned to exit the cavity 907. The lighter-heated liquid then exits the cavity 907 through the conduit 912. Consequently, after cooled liquid enters the cavity 907 at inlet 911 and is heated in the cavity 907, the heated liquid becomes lighter, rises, and exits the cavity at a point denoted by outlet 909. In one embodiment, the inlet 911, which receives the cooled liquid, is positioned below the outlet 909 where the heated liquid exits the cavity 907. In another embodiment, the inlet 911 and the outlet 909 may be repositioned in the housing 910 once the inlet 911 is positioned below the outlet 909.

Figure 10A:
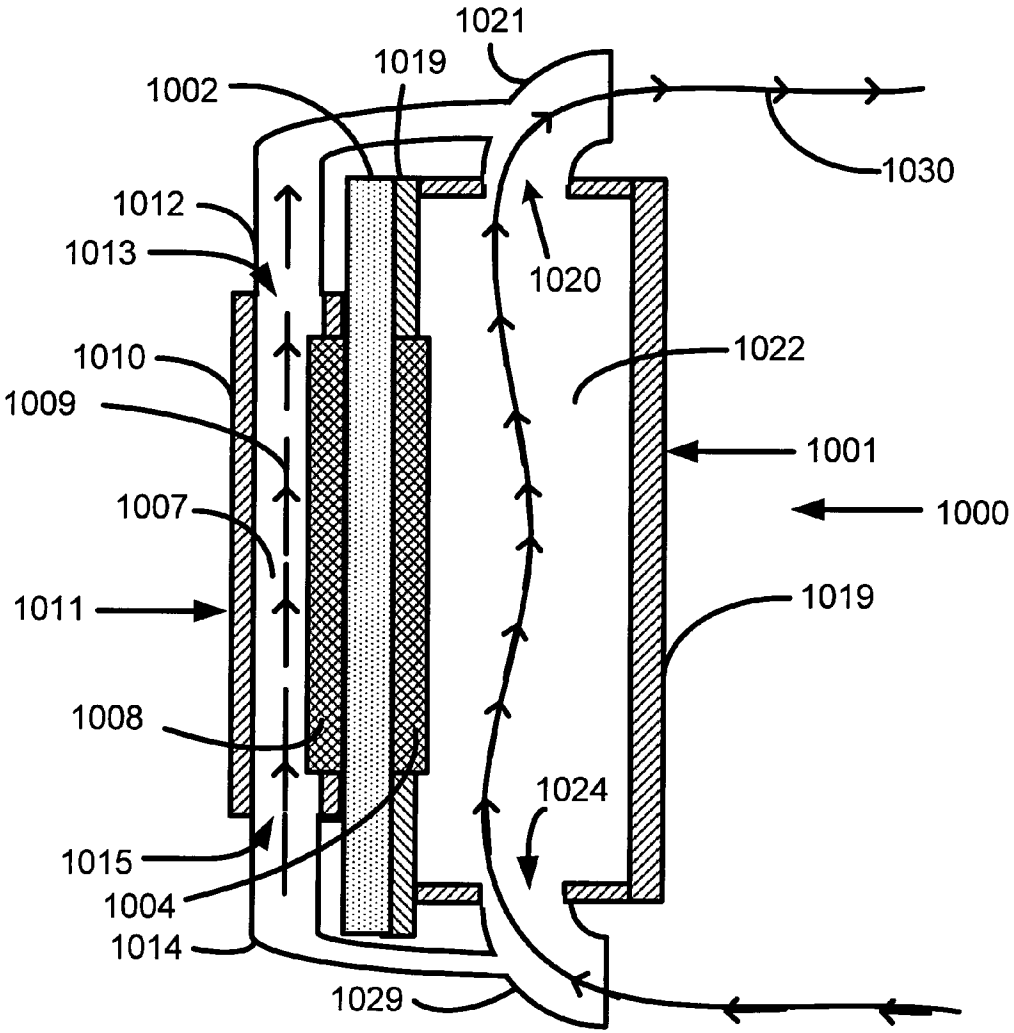
FIG. 10A displays a sectional view of an embodiment of a dual-surface, direct-exposure heat transfer system implemented in accordance with the teachings of the present invention.

FIG. 10A displays a sectional view of an embodiment of a dual-surface, direct-exposure heat transfer system 1000 implemented in accordance with the teachings of the present invention. It should be appreciated that the heat transfer system 1000 may be used with the liquid cooling systems depicted in FIGS. 1 through 5.

A processor 1002 is connected through first packaging material 1004 to a housing 1019 of heat transfer system 1001. In one embodiment, first packaging material 1004 may be any type of packaging material used to package a processor 1002. The housing 1019 may be manufactured from a suitable conductive or thermally insulating material. For example, materials such as copper and various plastics may be used. The housing 1019 is connected to the processor first packaging material 1004 through a variety of mechanisms, such as by clamping, adhesives, thermal paste socket fixtures, etc. Housing 1019 is mated to processor first packaging material 1004 to form a cavity 1022, which provides a conduit (i.e., liquid pathway) for liquid as shown by liquid flow path 1030. The cavity 1022 includes an inlet 1024, which provides an input for liquid to enter cavity 1022 and an outlet 1020, which provides an opening for liquid to exit the cavity 1022.

In one embodiment, cooled liquid is transported to the heat transfer system 1001 through conduit 1029. At the inlet 1024, cooled liquid enters the cavity 1022 of the heat transfer system 1001. The liquid flows over the first packaging material 1004 and is in direct contact with the first packaging material 1004. Heat is transported from processor 1002 through first packaging material 1004 to the liquid flowing through the cavity 1022. The cooled liquid, which enters the cavity 1022 and is in direct contact with the first packaging material 1004, is heated by the heat transferred through the first packaging material 1004 from the processor 1002. As the cooled liquid is heated, the cooled liquid is transformed into heated liquid. Since heated liquid is lighter than the cooled liquid, the heated liquid rises in cavity 1022. At the outlet 1020, the lighter-heated liquid is positioned to exit the cavity 1022. The lighter-heated liquid then exits the cavity 1022 through the conduit 1021. Consequently, after cooled liquid enters the cavity 1022 at inlet 1024 and is heated in the cavity 1022, the heated liquid becomes lighter, rises, and exits the cavity at a point denoted by outlet 1020. In one embodiment, the inlet 1024, which receives the cooled liquid, is positioned below the outlet 1020 where the heated liquid exits the cavity 1022 through conduit 1021. In another embodiment, the inlet 1024 and the outlet 1020 may be repositioned in the housing 1019 once the inlet 1024 is positioned below the outlet 1020.

The processor 1002 is connected through second packaging material 1008 to a housing 1010 of heat transfer system 1011. In one embodiment, second packaging material 1008 may be any type of packaging material used to package a processor 1002. The housing 1010 may be manufactured from a suitable conductive or thermally insulating material. For example, materials such as copper and various plastics may be used. The housing 1010 is connected to the processor second packaging material 1008 through a variety of mechanisms, such as by clamping, adhesives, thermal paste socket fixtures, etc. Housing 1010 is mated to processor second packaging material 1008 to form a cavity 1007, which provides a conduit (i.e., liquid pathway) for liquid as shown by liquid flow path 1009. The cavity 1007 includes an inlet 1015, which provides an input for liquid to enter cavity 1007 and an outlet 1013, which provides an opening for liquid to exit the cavity 1007.

In one embodiment, cooled liquid is transported to the heat transfer system 1011 through conduit 1014. At the inlet 1015, cooled liquid enters the cavity 1007 of the heat transfer system 1011. The liquid flows over the second packaging material 1008 and is in direct contact with the second packaging material 1008. Heat is transported from processor 1002 through second packaging material 1008 to the liquid flowing through the cavity 1007. The cooled liquid, which enters the cavity 1007 and is in direct contact with the second packaging material 1008, is heated by the heat transferred through the second packaging material 1008 from the processor 1002. As the cooled liquid is heated, the cooled liquid is transformed into heated liquid. Since heated liquid is lighter than the cooled liquid, the heated liquid rises in cavity 1007. At the outlet 1013, the lighter-heated liquid is positioned to exit the cavity 1007. The lighter-heated liquid then exits the cavity 1007 through the conduit 1012. Consequently, after cooled liquid enters the cavity 1007 at inlet 1015 and is heated in the cavity 1007, the heated liquid becomes lighter, rises, and exits the cavity at a point denoted by outlet 1013. In one embodiment, the inlet 1015, which receives the cooled liquid, is positioned below the outlet 1013 where the heated liquid exits the cavity 1007 through conduit 1012. In another embodiment, the inlet 1015 and the outlet 1013 may be repositioned in the housing 1010 once the inlet 1015 is positioned below the outlet 1013.

During one embodiment of the present invention, heat is generated by processor 1002 and is transferred through first packaging material 1004 and second packaging material 1008. As such, the liquid flowing through cavities 1022 and 1007 impact the packaging material 1004 and 1008, respectively. As a result, liquid impacts two sides of the processor 1002. As a result, heat is removed from both sides of the processor 1002.

Figure 10B:
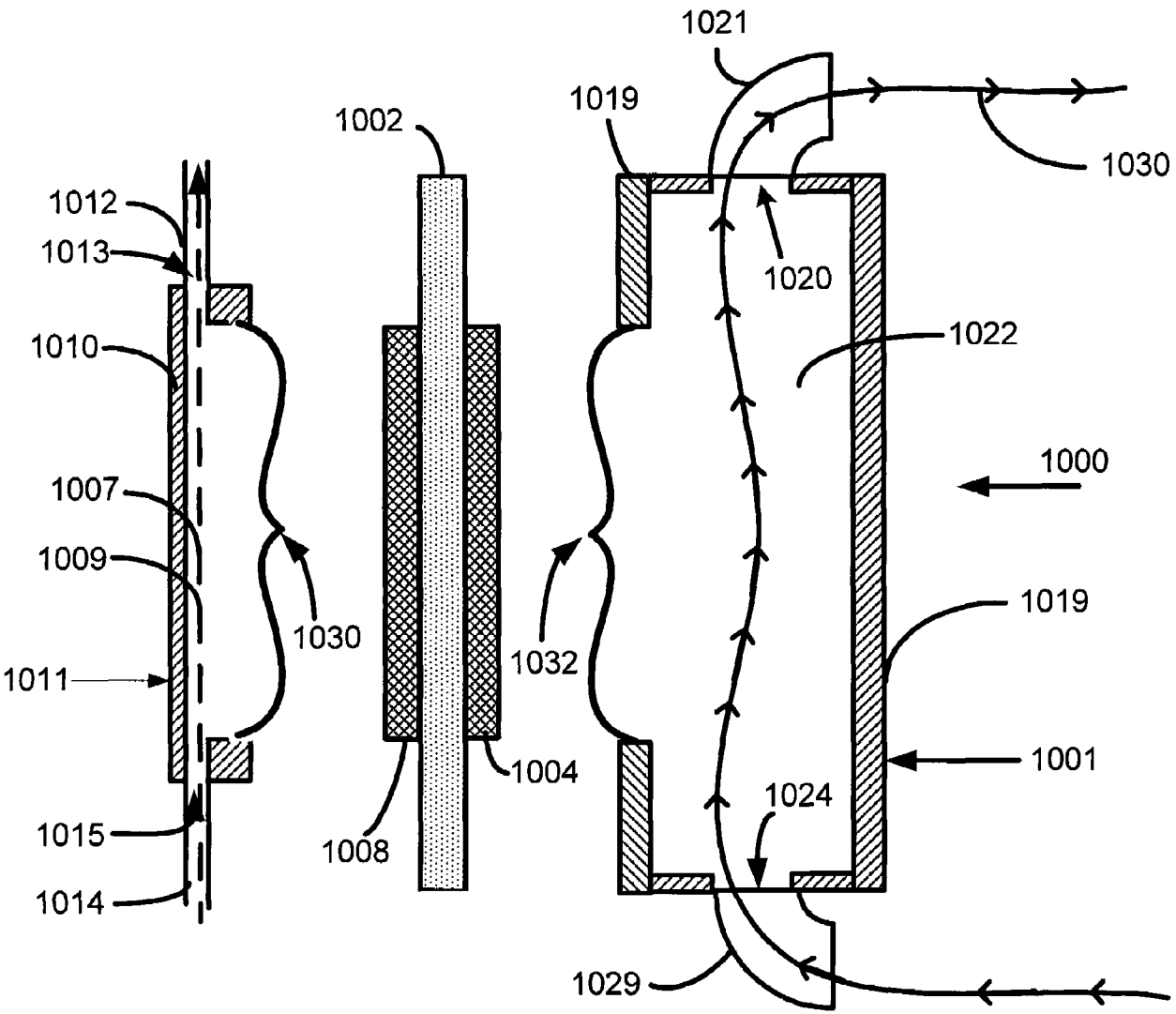
FIG. 10B displays an exploded view of the dual-surface, direct-exposure heat transfer system depicted in FIG. 10A.

FIG. 10B displays an exploded view of the dual-surface, direct-exposure heat transfer system depicted in FIG. 10A. It should be appreciated that the heat transfer system 1000 may be used with the liquid cooling system depicted in FIGS. 1 through 5.

A processor 1002 is connected through processor second packaging material 1008 to a housing 1010 of heat transfer system 1011. In one embodiment, processor second packaging material 1008 may be any type of packaging. The housing 1010 may be manufactured from a suitable conductive or thermally insulating material. For example, materials such as copper and various plastics may be used. The housing 1010 is connected to the processor second packaging material 1008 through a variety of mechanisms, such as by clamping, adhesives, thermal paste socket fixtures, etc. Housing 1010 is mated to processor second packaging material 1008 to form a cavity 1007, which provides a conduit (i.e., liquid pathway) for liquid as shown by liquid flow path 1009. In one embodiment, the processor second packaging material 1008 is mated to a receptacle shown as 1030, which is formed in the body of the housing 1010. In another embodiment, the processor second packaging material 1008 is attached to the housing 1010 through receptacle 1030 to form a cavity 1007. In one embodiment, the receptacle 1030 may include an opening in housing 1010 for mating with second packaging material 1008. In another embodiment, receptacle 1030 may include any addition fixtures, clips, connectors, adhesive, etc. used to mate second packaging material 1008 to the receptacle 1030.

The housing 1010 includes an inlet 1015, which provides an input for liquid to enter cavity 1007 and an outlet 1013, which provides an opening for liquid to exit the cavity 1007. In one embodiment, cooled liquid is transported to the heat transfer system 1011 through conduit 1014. At the inlet 1015, cooled liquid enters the heat transfer system 1011. The liquid flows over the second packaging material 1008 and is in direct contact with the second packaging material 1008. Heat is transported from processor 1002 through second packaging material 1008 to the liquid flowing through the cavity 1007. The second packaging material 1008 is mated with the receptacle 1030 so that the liquid is contained in the cavity 1007. The cooled liquid, which enters the cavity 1007 and is in direct contact with the second packaging material 1008, is heated by the heat transferred from the processor 1002 through the second packaging material 1008. As the cooled liquid is heated, the cooled liquid is transformed into heated liquid. Since heated liquid is lighter than the cooled liquid, the heated liquid rises in cavity 1007. At the outlet 1013, the lighter-heated liquid is positioned to exit the cavity 1007. The lighter-heated liquid then exits the cavity 1007 through the conduit 1012. Consequently, after cooled liquid enters the cavity 1007 at inlet 1015 and is heated in the cavity 1007, the heated liquid becomes lighter, rises, and exits the cavity 1007 at a point denoted by outlet 1013. In one embodiment, the inlet 1015, which receives the cooled liquid, is positioned below the outlet 1013 where the heated liquid exits the cavity 1007. In another embodiment, the inlet 1015 and the outlet 1013 may be repositioned in the housing 1010 once the inlet 1015 is positioned below the outlet 1013.

In one embodiment, cooled liquid is transported to a second heat transfer system 1001 through a conduit 1029. At the inlet 1024, cooled liquid enters the heat transfer system 1001. The liquid flows over the first packaging material 1004 and is in direct contact with the first packaging material 1004. Heat is transported from processor 1002 through first packaging material 1004 to the liquid flowing through the cavity 1022. The first packaging material 1004 is mated with the receptacle 1032 so that the liquid is contained in the cavity 1022. The cooled liquid, which enters the cavity 1022 and is in direct contact with the first packaging material 1004, is heated by the heat transferred from the processor 1002 through the first packaging material 1004. As the cooled liquid is heated, the cooled liquid is transformed into heated liquid. Since heated liquid is lighter than the cooled liquid, the heated liquid rises in cavity 1022. At the outlet 1020, the lighter-heated liquid is positioned to exit the cavity 1022. The lighter-heated liquid then exits the cavity 1022 through the conduit 1021. Consequently, after cooled liquid enters the cavity 1022 at inlet 1024 and is heated in the cavity 1022, the heated liquid becomes lighter, rises, and exits the cavity 1022 at a point denoted by outlet 1020. In one embodiment, the inlet 1024, which receives the cooled liquid, is positioned below the outlet 1020 where the heated liquid exits the cavity 1022. In another embodiment, the inlet 1024 and the outlet 1020 may be repositioned in the housing 1019 once the inlet 1024 is positioned below the outlet 1020.

Figure 11:
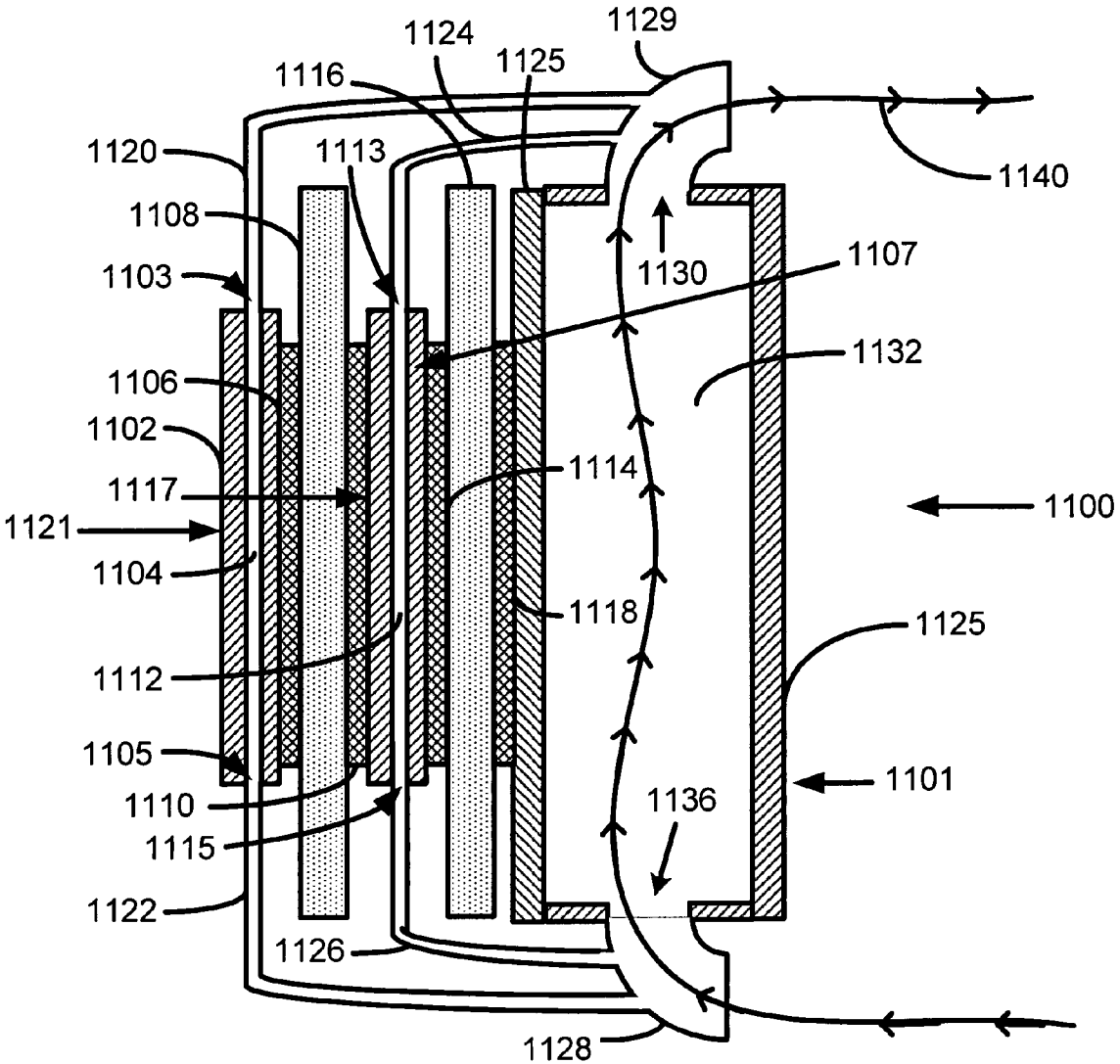
FIG. 11 displays a sectional view of an embodiment of a multi-processor, dual-surface heat transfer system implemented in accordance with the teachings of the present invention.

FIG. 11 displays a sectional view of an embodiment of a multi-processor, dual-surface heat transfer system 1100 implemented in accordance with the teachings of the present invention. It should be appreciated that the heat transfer system 1100 may be used with the liquid cooling system depicted in FIGS. 1 through 5.

The dual-surface heat transfer system 1100 includes multiple heat transfer systems depicted as 1101, 1117, and 1121. Heat transfer system 1101 includes a housing 1125, which forms a cavity 1132. The cavity 1132 provides a flow path 1140 (i.e., liquid pathway). The housing 1125 includes an inlet 1136, which provides an input for liquid to enter cavity 1132 and an outlet 1130, which provides an opening for liquid to exit the cavity 1132.

In one embodiment, cooled liquid is transported to the heat transfer system 1101 through conduit 1128. At the inlet 1136, cooled liquid enters the heat transfer system 1101. Heated liquid exits the cavity 1132 at an outlet 1130. The outlet 1130 is connected to conduit 1129.

A processor 1116 includes packaging material 1118 and packaging material 1114. In one embodiment, the processor 1116 includes packaging material 1118 on one side of the processor 1116 and packaging material 1114 on an oppositely disposed side of the processor 1116 from the packaging material 1118. In another embodiment, the packaging material 1118 may be disposed on a first side of processor 1116 and packaging material 1114 may be disposed on any second side of processor 1116. The housing 1125 engages the packaging material 1118.

Heat transfer system 1117 is shown. Heat transfer system 1117 includes a housing 1107, which forms a cavity 1112. The cavity 1112 provides a flow path (i.e., liquid pathway). The housing 1107 includes an inlet 1115, which provides an input for liquid to enter cavity 1112 and an outlet 1113, which provides an opening for liquid to exit the cavity 1112.

In one embodiment, cooled liquid is transported to the heat transfer system 1117 through conduit 1126. At the inlet 1115, cooled liquid enters the heat transfer system 1117. Heated liquid exits the cavity 1112 at an outlet 1113. The outlet 1113 is connected to conduit 1124.

Heat transfer system 1121 is shown. Heat transfer system 1121 includes a housing 1102, which forms a cavity 1104. The cavity 1104 provides a flow path (i.e., liquid pathway). The housing 1102 includes an inlet 1105, which provides an input for liquid to enter cavity 1104 and an outlet 1103, which provides an opening for liquid to exit the cavity 1104.

In one embodiment, cooled liquid is transported to the heat transfer system 1121 through conduit 1122. At the inlet 1105, cooled liquid enters the heat transfer system 1121. Heated liquid exits the cavity 1104 at an outlet 1103. The outlet 1103 is connected to conduit 1120.

During operation, processor 1116 produces heat, which is transferred through packaging material 1114 and packaging material 1118. As heat flows through the packaging material 1114 and the packaging material 1118 to liquid flowing through cavities 1132 and 1112, the heat from the processor 1116 is removed. Processor 1108 also produces heat, which is transferred through packaging material 1110 and 1106. As heat flows through the packaging material 1110 and 1106 to liquid flowing through cavities 1112 and 1104, heat from processor 1108 is removed.

In one embodiment, cooled liquid is transported to the heat transfer system 1101 through conduit 1128. At the inlet 1136, cooled liquid enters the heat transfer system 1101. Heat is transported from processor 1116 through packaging material 1118 to the liquid flowing through the cavity 1132. As the cooled liquid is heated, the cooled liquid is transformed into heated liquid. Since heated liquid is lighter than the cooled liquid, the heated liquid rises in cavity 1132. At the outlet 1130, the lighter-heated liquid is positioned to exit the cavity 1132. The lighter-heated liquid then exits the cavity 1132 through the conduit 1129. Consequently, after cooled liquid enters the cavity 1132 at inlet 1136 and is heated in the cavity 1132, the heated liquid becomes lighter, rises, and exits the cavity at a point denoted by outlet 1130. In one embodiment, the inlet 1136, which receives the cooled liquid, is positioned below the outlet 1130 where the heated liquid exits the cavity 1132. In another embodiment, the inlet 1136 and the outlet 1130 may be repositioned in the housing 1125 once the inlet 1136 is positioned below the outlet 1130.

In one embodiment, cooled liquid is transported to the heat transfer system 1117 through conduit 1126. At the inlet 1115, cooled liquid enters the heat transfer system 1117. Heat is transported from processor 1116 through packaging material 1114 to the liquid flowing through the cavity 1112. As the cooled liquid is heated, the cooled liquid is transformed into heated liquid. Since heated liquid is lighter than the cooled liquid, the heated liquid rises in cavity 1112. At the outlet 1113, the lighter-heated liquid is positioned to exit the cavity 1112. The lighter-heated liquid then exits the cavity 1112 through the conduit 1124. Consequently, after cooled liquid enters the cavity 1112 at inlet 1115 and is heated in the cavity 1112, the heated liquid becomes lighter, rises, and exits the cavity 1112 at a point denoted by outlet 1113. In one embodiment, the inlet 1115, which receives the cooled liquid, is positioned below the outlet 1113 where the heated liquid exits the cavity 1112. In another embodiment, the inlet 1115 and the outlet 1113 may be repositioned in the housing 1107 once the inlet 1115 is positioned below the outlet 1113.

In one embodiment, cooled liquid is transported to the heat transfer system 1121 through conduit 1122. At the inlet 1105, cooled liquid enters the heat transfer system 1121. Heat is transported from processor 1108 through packaging material 1106 to the liquid flowing through the cavity 1104. As the cooled liquid is heated, the cooled liquid is transformed into heated liquid. Since heated liquid is lighter than the cooled liquid, the heated liquid rises in cavity 1104. At the outlet 1103, the lighter-heated liquid is positioned to exit the cavity 1104. The lighter-heated liquid then exits the cavity 1104 through the conduit 1120. Consequently, after cooled liquid enters the cavity 1104 at inlet 1105 and is heated in the cavity 1104, the heated liquid becomes lighter, rises, and exits the cavity at a point denoted by outlet 1103. In one embodiment, the inlet 1105, which receives the cooled liquid, is positioned below the outlet 1103 where the heated liquid exits the cavity 1104. In another embodiment, the inlet 1105 and the outlet 1103 may be repositioned in the housing 1102 once the inlet 1105 is positioned below the outlet 1103.

Figure 12A:
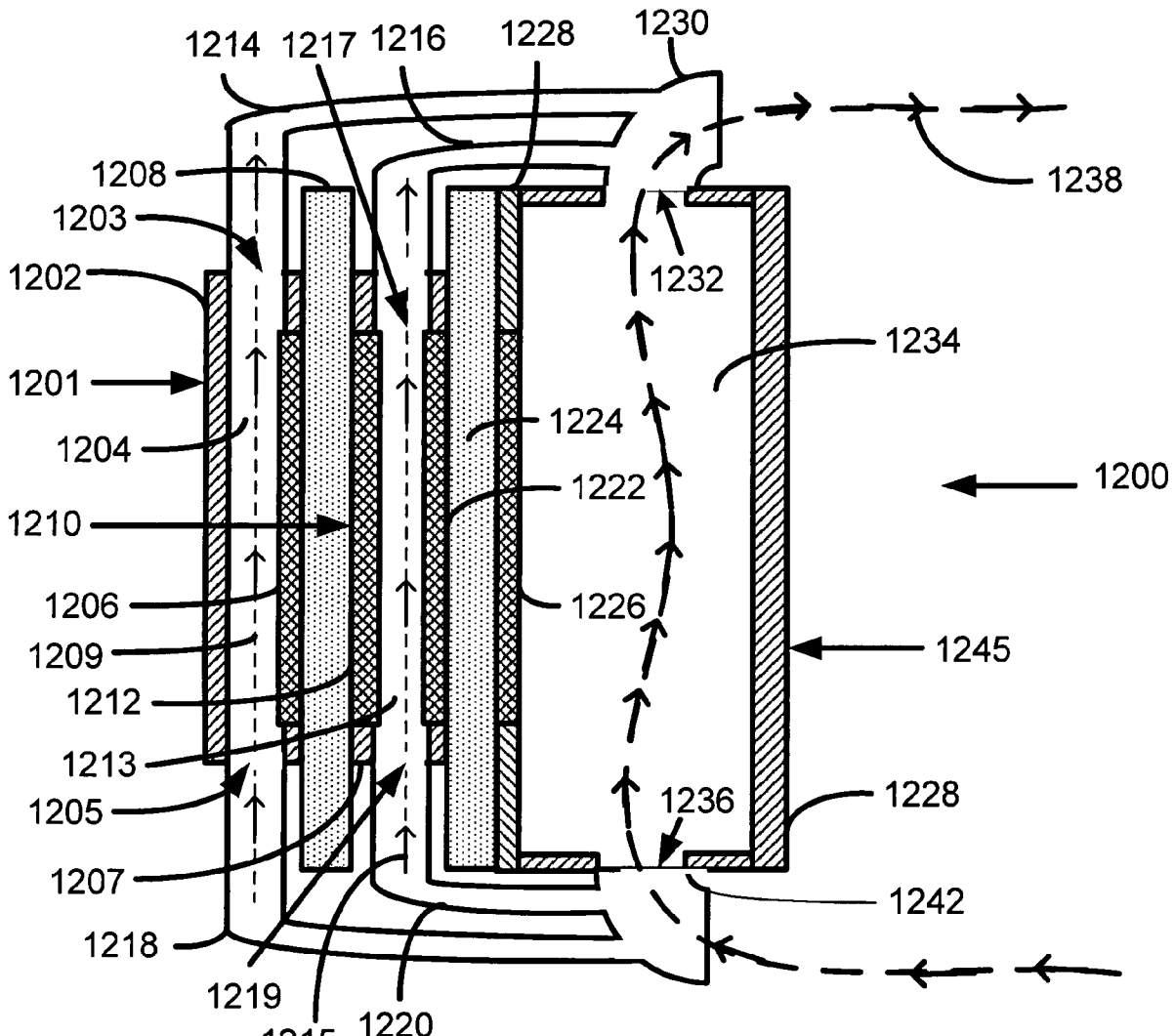
FIG. 12A displays a sectional view of an embodiment of a multi-processor, direct-exposure heat transfer system implemented in accordance with the teachings of the present invention.

FIG. 12A displays a sectional view of an embodiment of a multi-processor, direct-exposure heat transfer system implemented in accordance with the teachings of the present invention. It should be appreciated that the heat transfer system 1200 may be used with the liquid cooling system depicted in FIGS. 1 through 5.

The multi-processor, dual surface, direct emersion heat transfer system 1200 includes multiple heat transfer systems depicted as 1201, 1210, and 1245. Heat transfer system 1245 includes a housing 1228, which mates with packaging material 1226 to form a cavity 1234. The cavity 1234 provides a flow path 1238 (i.e., liquid pathway). The housing 1228 includes an inlet 1236, which provides an input for liquid to enter cavity 1234 and an outlet 1232, which provides an opening for liquid to exit the cavity 1234.

In one embodiment, cooled liquid is transported to the heat transfer system 1245 through conduit 1242. At the inlet 1236, cooled liquid enters the heat transfer system 1245. Heated liquid exits the cavity 1234 at an outlet 1232. The outlet 1232 is connected to a conduit 1230.

A processor 1224 is coupled to packaging material 1226 and packaging material 1222. In one embodiment, the processor 1224 includes packaging material 1226 on one side of the processor 1224 and packaging material 1222 on an oppositely disposed side of the processor 1224 from the packaging material 1226. In another embodiment, the packaging material 1226 may be disposed on a first side of processor 1224 and packaging material 1222 may be disposed on any second side of processor 1224. The housing 1228 mates with the packaging material 1226.

Heat transfer system 1210 is shown. Heat transfer system 1210 includes a housing 1207, which forms a cavity 1213 when the housing 1207 mates with packaging material 1222 and packaging material 1212. The cavity 1213 provides a flow path (i.e., liquid pathway). The housing 1207 includes an inlet 1219, which provides an input for liquid to enter cavity 1213 and an outlet 1217, which provides an opening for liquid to exit the cavity 1213.

In one embodiment, cooled liquid is transported to the heat transfer system 1210 through a conduit 1220. At the inlet 1219, cooled liquid enters the heat transfer system 1210. Heated liquid exits the cavity 1212 at an outlet 1219. The outlet 1219 is connected to a conduit 1220. In one embodiment, the liquid flows along flow path 1215.

Heat transfer system 1201 is shown. Heat transfer system 1201 includes a housing 1202, which forms a cavity 1204. The cavity 1204 provides a flow path (i.e., liquid pathway). The housing 1202 includes an inlet 1205, which provides an input for liquid to enter cavity 1204 and an outlet 1203, which provides an opening for liquid to exit the cavity 1204.

In one embodiment, cooled liquid is transported to the heat transfer system 1201 through conduit 1214. At the inlet 1205, cooled liquid enters the heat transfer system 1201. Heated liquid exits the cavity 1204 at an outlet 1203. The outlet 1203 is connected to conduit 1218. In one embodiment, the liquid flows along flow path 1209.

In one embodiment, cooled liquid is transported to the heat transfer system 1245 through conduit 1242. At the inlet 1236, cooled liquid enters the heat transfer system 1245. Liquid in cavity 1234 comes in direct contact with packaging material 1226. Heat is transported from processor 1224 through packaging material 1226 to the liquid flowing through the cavity 1234. As the cooled liquid is heated, the cooled liquid is transformed into heated liquid. Since heated liquid is lighter than the cooled liquid, the heated liquid rises in cavity 1234. At the outlet 1232, the lighter-heated liquid is positioned to exit the cavity 1234. The lighter-heated liquid then exits the cavity 1234 through the conduit 1230. Consequently, after cooled liquid enters the cavity 1234 at inlet 1236 and is heated in the cavity 1234, the heated liquid becomes lighter, rises, and exits the cavity 1234 at a point denoted by outlet 1232. In one embodiment, the inlet 1236, which receives the cooled liquid, is positioned below the outlet 1232 where the heated liquid exits the cavity 1234. In another embodiment, the inlet 1236 and the outlet 1232 may be repositioned in the housing 1228 once the inlet 1236 is positioned below the outlet 1232.

In one embodiment, cooled liquid is transported to the heat transfer system 1210 through conduit 1220. At the inlet 1219, cooled liquid enters the heat transfer system 1210. Liquid in cavity 1213 comes in direct contact with packaging material 1212 and packaging material 1222. Heat is transported from processor 1224 through packaging material 1212 and packaging material 1222 to the liquid flowing through the cavity 1213. As the cooled liquid is heated, the cooled liquid is transformed into heated liquid. Since heated liquid is lighter than the cooled liquid, the heated liquid rises in cavity 1213. At the outlet 1217, the lighter-heated liquid is positioned to exit the cavity 1213. The lighter-heated liquid then exits the cavity 1213 through the conduit 1216. Consequently, after cooled liquid enters the cavity 1213 at inlet 1219 and is heated in the cavity 1213, the heated liquid becomes lighter, rises, and exits the cavity 1213 at a point denoted by outlet 1217. In one embodiment, the inlet 1219, which receives the cooled liquid, is positioned below the outlet 1217 where the heated liquid exits the cavity 1213. In another embodiment, the inlet 1219 and the outlet 1217 may be repositioned in the housing 1207 once the inlet 1219 is positioned below the outlet 1217.

In one embodiment, cooled liquid is transported to the heat transfer system 1201 through conduit 1218. At the inlet 1205, cooled liquid enters the heat transfer system 1201. Liquid in cavity 1204 comes in direct contact with packaging material 1206. Heat is transported from processor 1208 through packaging material 1206 to the liquid flowing through the cavity 1204. As the cooled liquid is heated, the cooled liquid is transformed into heated liquid. Since heated liquid is lighter than the cooled liquid, the heated liquid rises in cavity 1204. At the outlet 1203, the lighter-heated liquid is positioned to exit the cavity 1204. The lighter-heated liquid then exits the cavity 1204 through the conduit 1214. Consequently, after cooled liquid enters the cavity 1204 at inlet 1205 and is heated in the cavity 1204, the heated liquid becomes lighter, rises, and exits the cavity 1204 at a point denoted by outlet 1203. In one embodiment, the inlet 1205, which receives the cooled liquid, is positioned below the outlet 1203 where the heated liquid exits the cavity 1204. In another embodiment, the inlet 1205 and the outlet 1203 may be repositioned in the housing 1202 once the inlet 1205 is positioned below the outlet 1203.

Figure 12B:
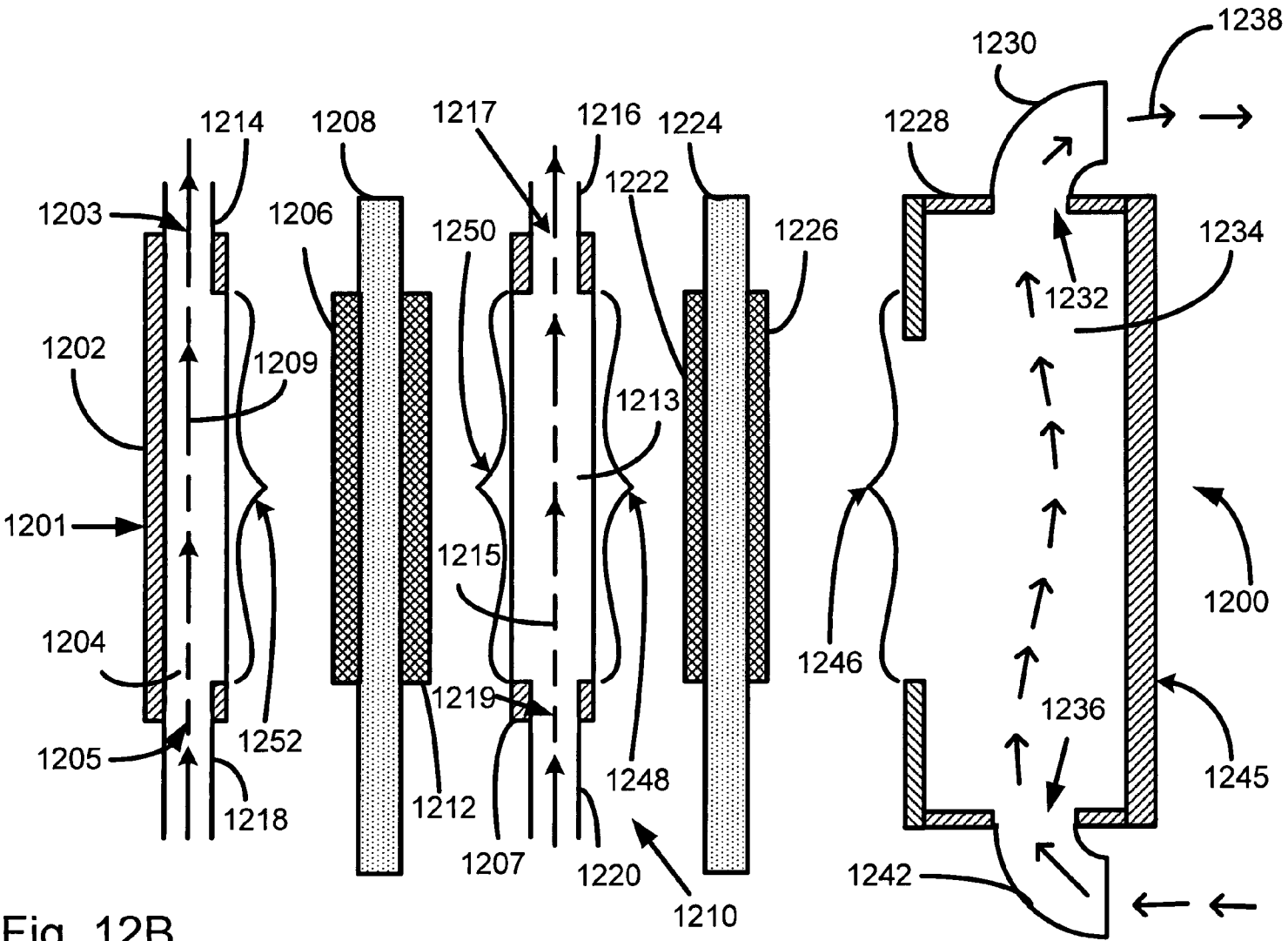
FIG. 12B displays an exploded view of the multi-processor, direct-exposure heat transfer system depicted in FIG. 12A.

FIG. 12B displays an exploded view of the multi-processor, direct-exposure heat transfer system depicted in FIG. 12A. It should be appreciated that the heat transfer system 1200 may be implemented in the liquid cooling system depicted in FIGS. 1 through 5.

The heat transfer system 1200 includes multiple heat transfer systems depicted as 1201, 1210, and 1245. Heat transfer system 1201 includes a housing 1202, which mates with packaging material 1206 at receptacle 1252 to form a cavity 1204. Conduit 1218 transports liquid to cavity 1204 through inlet 1205 and conduit 1214 transports liquid out of cavity 1204 through outlet 1203. Heat transfer system 1210 includes a housing 1207, which mates with packaging material 1212 and packaging material 1222 at receptacles 1250 and 1248 to form a cavity 1213. Conduit 1220 transports liquid to cavity 1213 through inlet 1219 and conduit 1216 transports liquid out of cavity 1213 through outlet 1217. Heat transfer system 1245 includes housing 1228, which mates with packaging material 1226 at receptacle 1246 to form a cavity 1234. Conduit 1242 transports liquid to cavity 1234 through inlet 1236 and conduit 1230 transports liquid out of cavity 1234 through outlet 1232. Each cavity 1204, 1213, and 1234 provide flow paths 1209, 1215 and 1238 for liquid flowing through the cavity 1204, 1213, and 1234.

The processor 1224 includes packaging material 1226 and packaging material 1222. The processor 1208 includes packaging material 1206 and packaging material 1212. It should be appreciated that packaging material may be deployed on any side of the processor and still remain within the scope of the present invention.

Heat transfer system 1245 includes one receptacle 1246. In one embodiment, the receptacle 1246 is implemented as an opening sized to receive the packaging material 1226 and create a cavity 1234. As such, heat transfer system 1200 may be used to cool the processor 1224 by cooling one side of the processor 1224. In another embodiment, receptacle 1246 may be implemented with sockets or another type of attachment mechanism to connect the packaging material 1226 to the receptacle 1246. It should be appreciated that the packaging material, such as packaging material 1226, may be sized in a number of different ways. For example, the packaging material 1226 may be sized to fit within the receptacle 1246 or the packaging material 1226 may be sized to sit on top of the housing 1228 and still form a cavity 1234. It should be appreciated that the receptacle 1246 may be sized and configured using a number of alternative techniques. However, it should be appreciated that receptacle 1246 is configured to mate with the processor 1224.

Heat transfer system 1210 includes two receptacles 1248 and 1250. In one embodiment, the receptacles 1248 and 1250 are implemented as an opening sized to receive the packaging material 1222 and 1212. Mating the packaging material 1222 and 1212 with the receptacles 1248 and 1250, respectively, forms the cavity 1213. As such, heat transfer system 1210 may be used to cool the bottom of processor 1208 and the top of processor 1224. In another embodiment, receptacles 1248 and 1250 may be implemented with sockets or another type of attachment mechanism to connect the packaging material 1222 to receptacle 1248 and packaging material 1212 to receptacle 1250. It should be appreciated that the packaging material, such as packaging material 1222 and 1212, may be sized to fit within the receptacle 1248 and receptacle 1250, respectively. The packaging material 1212 and 1222 may be sized to sit on top of the housing 1207 and still form a cavity 1213. It should be appreciated that the receptacles 1248 and 1250 may be sized and configured using a number of alternative techniques. However, it should be appreciated that receptacles 1248 and 1250 are configured to mate with the processors 1224 and 1208.

Heat transfer system 1201 includes one receptacle 1252. In one embodiment, the receptacle 1252 is implemented as an opening sized to receive the packaging material 1206 and create a cavity 1204. As such, heat transfer system 1201 may be used to cool the processor 1208 by cooling one side of the processor 1208. In another embodiment, receptacle 1252 may be implemented with sockets or another type of attachment mechanism to connect the packaging material 1206 to the receptacle 1252. It should be appreciated that the packaging material, such as packaging material 1206, may be sized in a number of different ways. For example, the packaging material 1206 may be sized to fit within the receptacle 1252 or the packaging material 1206 may be sized to sit on top of the housing 1202 and still form a cavity 1204. It should be appreciated that the receptacle 1252 may be sized and configured using a number of alternative techniques. However, it should be appreciated that receptacle 1252 is configured to mate with the processor 1208.

Figure 13B:
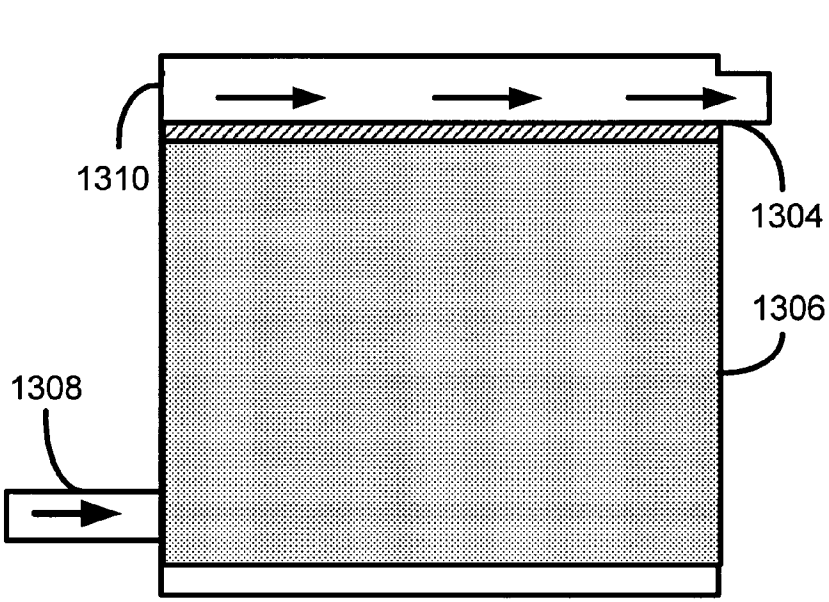
FIG. 13B displays a cross sectional view of an embodiment of a multi-surface heat transfer system implemented in accordance with the teachings of the present invention.
Figure 13A:
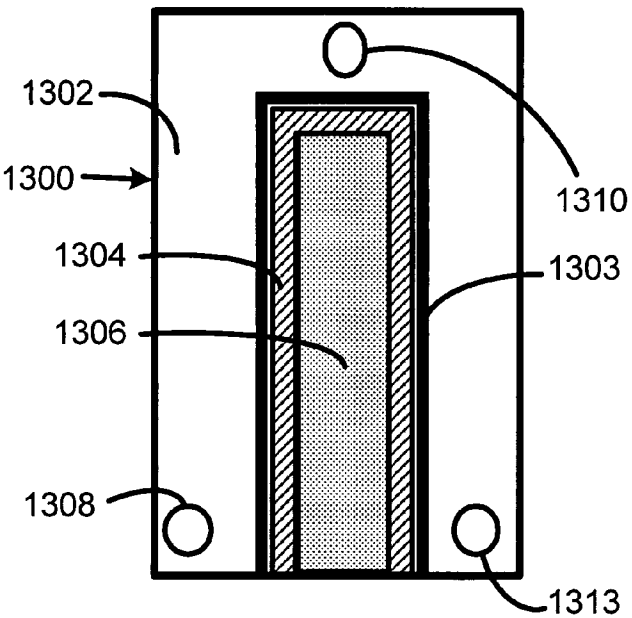
FIG. 13A displays a front sectional view of an embodiment of a multi-surface heat transfer system implemented in accordance with the teachings of the present invention.

FIG. 13A displays a front sectional view of an embodiment of a multi-surface, heat transfer system implemented in accordance with the teachings of the present invention. Heat transfer system 1300 may be implemented in the liquid cooling systems shown in FIGS. 1 through 5. The heat transfer system 1300 is shown as covering three sides of a processor. In one embodiment, heat transfer system 1300 is manufactured from a thermally conductive material such as copper. In another embodiment, heat transfer system 1300 is manufactured from an insulating material. In yet another embodiment, heat transfer system 1300 is manufactured from a combination of conductive materials and insulating materials.

In FIG. 13A, a semiconductor material is shown as 1306. The semiconductor material 1306 is covered on three sides with packaging material 1304. However, it should be appreciated that the semiconductor material 1306 may be covered on four sides, five sides, or all six sides with packaging material 1304 and still remain within the scope of the present invention. In one embodiment of the present invention, the semiconductor material 1306 and the packaging material 1304 represent a processor.

In one embodiment, cavity 1302 has an inner wall 1303 that forms a container for liquid flowing through the heat transfer system 1300. In this configuration, the cavity 1302 is positioned around the packaging material 1304 to provide cooling for the semiconductor material 1306. Liquid then flows through the cavity 1302 and does not leak there from. In a second embodiment, inner wall 1303 is removed and the liquid circulating in the cavity 1302 is in direct contact with the packaging material 1304. In both embodiments, cooled liquid enters the cavity 1302 through conduits 1308 and 1313. Heated liquid then exits the cavity 1302 through conduits 1310.

Figure 13C:
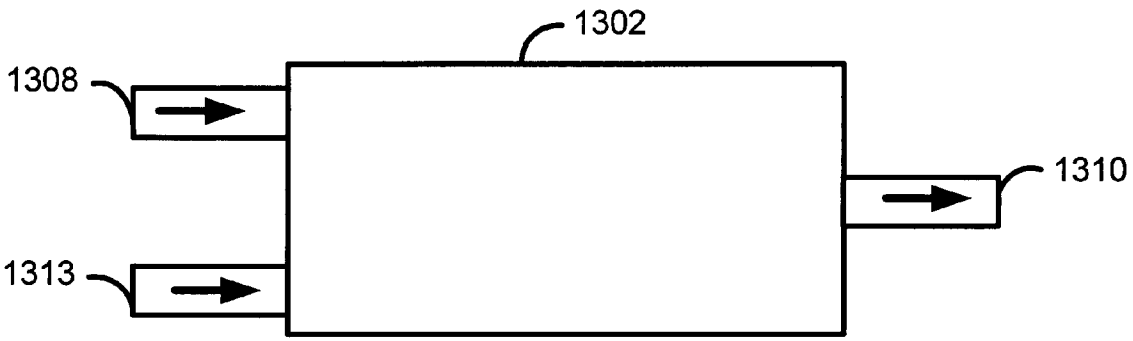
FIG. 13C displays a top view of an embodiment of a multi-surface heat transfer system implemented in accordance with the teachings of the present invention.

During operation, cooled liquid is transported to the heat transfer system 1300 through conduits 1308 and 1313. Heat is transported from processor through packaging material 1304 to the liquid flowing through the cavity 1302. As the cooled liquid is heated, the cooled liquid is transformed into heated liquid. Since heated liquid is lighter than the cooled liquid, the heated liquid rises in cavity 1302. The lighter-heated liquid then exits the cavity 1302 through the conduit 1310. Consequently, after cooled liquid enters the cavity 1302 and is heated in the cavity 1302, the heated liquid becomes lighter, rises, and exits the cavity 1302 through the conduit 1310. In one embodiment, the conduits 1308 and 1313, which receive the cooled liquid, are positioned below the conduit 1310. In another embodiment, the conduits 1308 and 1313 attachment point may be repositioned in the cavity 1302 once the conduits 1308 and 1313 are positioned below the conduit 1310 attachment point. FIG. 13B is a sectional side view of heat transfer system 1300. FIG. 13C shows a top view of a heat transfer system 1300.

Figure 14B:
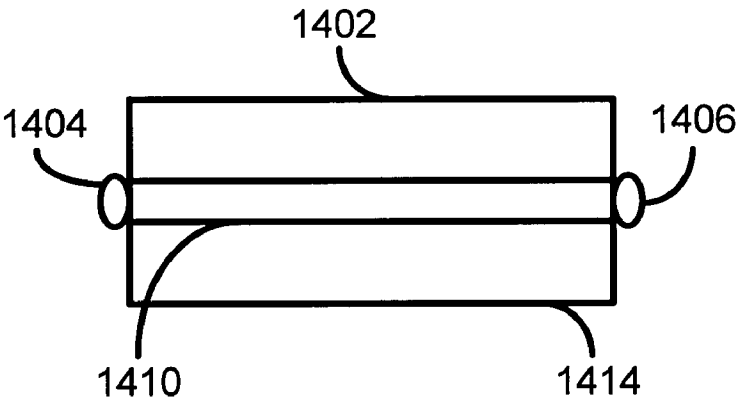
FIG. 14B displays a cross view of a heat transfer system implemented in a circuit board.
Figure 14C:
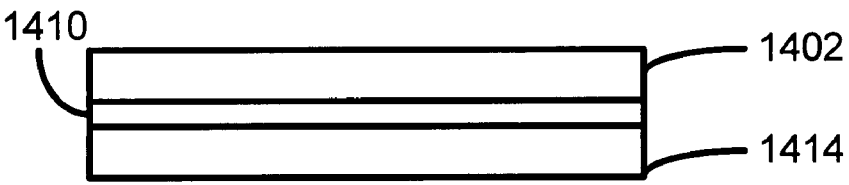
FIG. 14C displays a longitudinal sectional view of a heat transfer system implemented in a circuit board.
Figure 14A:
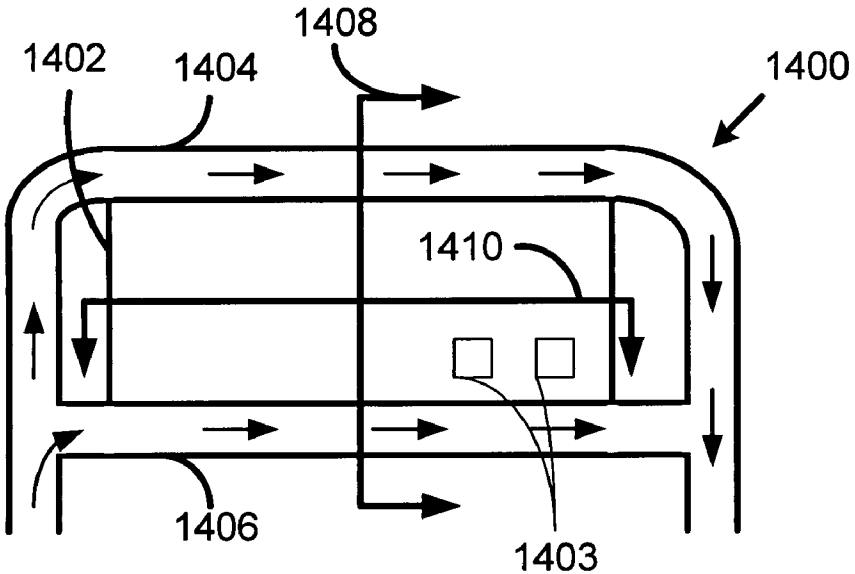
FIG. 14A displays a top view of a heat transfer system implemented in a circuit board.

FIG. 14A displays a top view of a circuit board implementation of a heat transfer system 1400. The circuit board 1402 may represent a motherboard in a computer, a computer board in a handheld device, etc. In one embodiment, the circuit board 1402 is implemented as a printed circuit board (PCB). In another embodiment, the circuit board 1402 is a motherboard with a variety of circuits, processors, etc. connected to the motherboard. Lastly, circuit board 1402 may represent any electronic related board that combines or is meant to combine with heat producing elements, where heat producing elements may consist of metallic elements, traces, circuits, processors, etc.

FIG. 14B displays a cross-sectional view of a heat transfer system implemented in a circuit board. In FIG. 14B, circuit board 1402 is shown and circuit board 1414 is shown. In addition, a conductive material is shown as 1410. The conductive material 1410 may be implemented with a material suitable for transporting heat, such as copper. The conductive material 1410 may be dispersed across the entire circuit boards 1402 and 1414. The conductive material 1410 may be positioned in certain sections of circuit boards 1402 and 1414. The conductive material 1410 may be implemented as strips positioned between circuit boards 1402 and 1414.

In one embodiment, the conductive material 1410 is connected to the liquid conduits 1406 and 1404. The liquid conduits 1404 and 1406 may be made of the same material as the conductive material 1410 or the liquid conduits 1404 and 1406 may be made of different materials. Further, it should be appreciated that the conductive material 1410 may be connected to the liquid conduits 1404 and 1406 so that liquid flowing in the liquid conduits 1404 and 1406 may come in direct contact with the conductive material 1410.

FIG. 14C displays a longitudinal sectional view of a heat transfer system implemented in a circuit board. FIG. 14C displays a longitudinal sectional view of a heat transfer system 1400 along sectional lines 1408 of FIG. 14A. During operation, heat is generated in the circuit board 1402. The heat may be generated by circuits or conductive material in the board or the heat may be generated by processors attached to the conductive material 1410, etc. For examples, as the circuits in the circuit board 1402 or in the processors heat up, the heat is then distributed throughout the conductive material 1410. As cooled liquid flows through the conduits 1404 and 1406 of FIG. 14B, the cooled liquid is heated, transferring the heat from the conductive material 1410 to the conduits 1404 and 1406 of FIG. 14B. As heat is transferred from the conductive material 1410 to the liquid flowing through conduits 1404 and 1406 of FIG. 14B, the circuits in the circuit boards 1402 and 1414 and the circuits and processors connected to circuit board 1402 and 1414 are cooled.

During operation, heat is generated by heat generating elements 1403. The heat is transported by conductive material 1410. As coolant flows through conduits 1404 and 1406, heat is removed. In one embodiment of the present invention, the circuit board implementation of a heat transfer system 1400 is connected to any one of the foregoing heat exchange units depicted in FIGS. 1-5. As a result, cooled liquid is transported from the heat exchange system to the circuit board implementation of a heat transfer system 1400. The cooled liquid is transported through conduits 1404 and 1406. Heat is transported from the conductive material 1410 to the cooled liquid transported through conduits 1404 and 1406. As a result, the cooled liquid transported through conduits 1404 and 1406 becomes heated liquid. The heated liquid is then transported back to the heat exchange system for cooling.

Figure 15B:
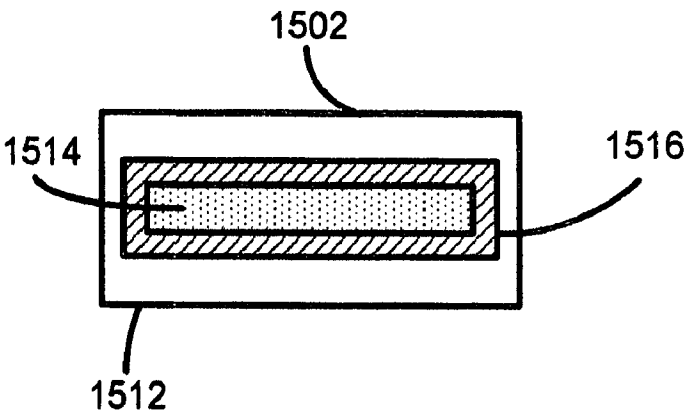
FIG. 15B displays a sectional view of a second embodiment of a heat transfer system implemented in a circuit board.
Figure 15A:
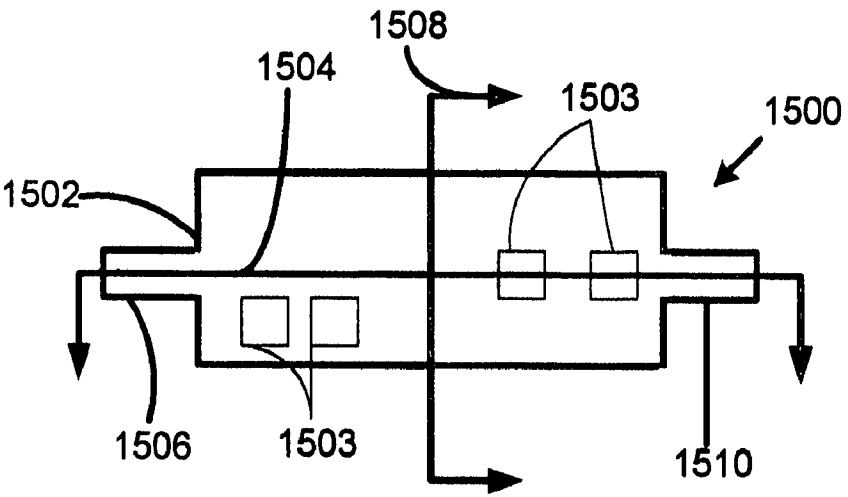
FIG. 15A displays a top view of a second embodiment of a heat transfer system implemented in a circuit board.
Figure 15C:
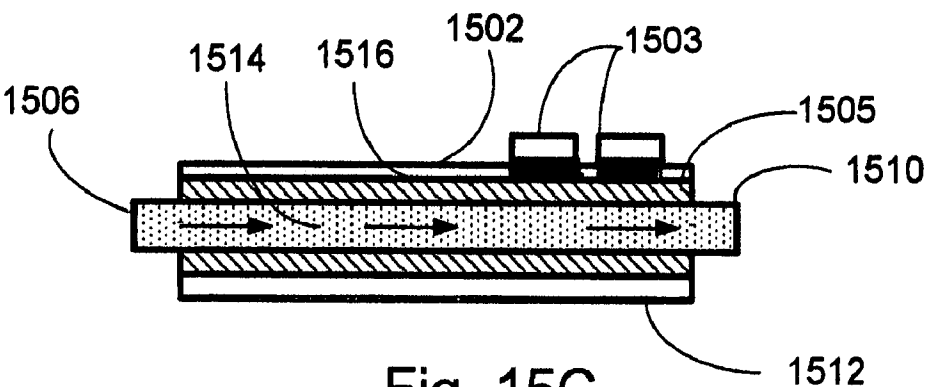
FIG. 15C displays a longitudinal sectional view of a second embodiment of a heat transfer system implemented in a circuit board.
Figure 15D:
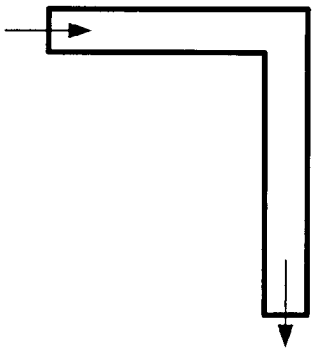
FIGS. 15D through 15I displays a variety of embodiments that may used to implement heat conducting material 1516 of FIGS. 15B and 15C.
Figure 15E:
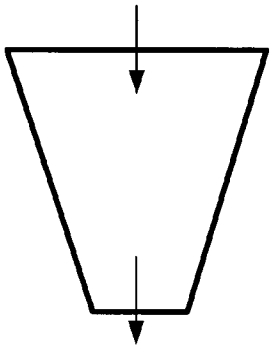
Figure 15F:
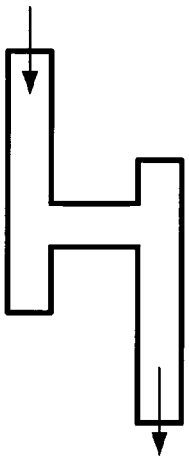
Figure 15G:
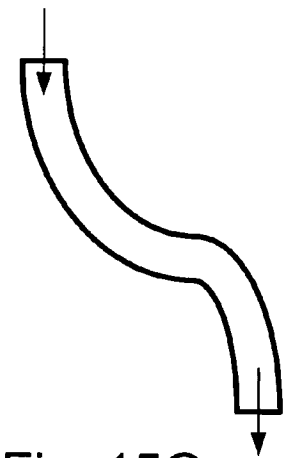
Figure 15H:
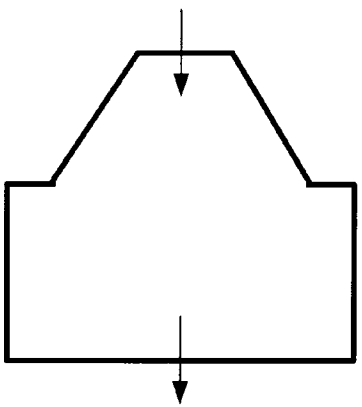
Figure 15I:
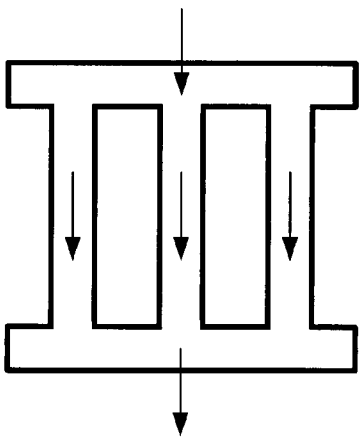

FIG. 15A displays a top view of a circuit board implementation of a heat transfer system 1500 implemented in accordance with the teachings of the present invention. FIG. 15B displays a cross-sectional view of a circuit board implemented in accordance with the teachings of the present invention. FIG. 15C displays a cross-sectional view of a circuit board implemented in accordance with the teachings of the present invention. The circuit board implementation of a heat transfer system shown in FIGS. 15A, 15B and 15C may be implemented in any of the foregoing liquid cooling systems.

FIG. 15A displays a top view of circuit board implemented in accordance with the teachings of the present invention. The circuit board 1502 may include any circuit board, such as a printed circuit board. In the alternative, any receptacle used to receive and house circuits, processors, etc. may be considered a circuit board 1502 and is within the scope of the present invention.

During operation, a heat conductor (not shown in FIG. 15) is deployed within the circuit board 1502. The heat conductor is formed within the circuit board 1502. In one embodiment, the heat conductor is made from a highly conductive material, such as copper. In one embodiment, heat generating elements 1503 such as circuits, processors, etc., are deployed in the circuit board 1502 and make contact with the heat conductor when the heat generating elements 1503 are deployed in the circuit board 1502. In an alternate embodiment, heat generating elements 1503 are deployed in proximity to circuit board 1502 and transmit heat to circuit board 1502.

FIG. 15B displays a sectional view of the circuit board along section lines 1508 of FIG. 15A. The circuit board 1502 includes a heat conductor 1516 deployed within the circuit board 1502. In one embodiment, the heat conductor 1516 is deployed to form a cavity 1514. The cavity 1514 serves as a conduit for liquid. It should be appreciated that the heat conductor 1516 may be deployed in a variety of configurations. It should be appreciated that the heat conductor 1516 may take a variety of different shapes and configurations. For example, the heat conductor 1516 may be deployed uniformly throughout the circuit board 1502 or the heat conductor 1516 may be deployed non-uniformly throughout the circuit board 1502.

FIG. 15C displays a sectional view of the circuit board along section lines 1508 of FIG. 15A. A circuit board 1502 is shown. The heat conducting material 1516 is deployed within the circuit board 1502. A liquid conduit 1506 is formed within the heat conducting material 1516. Liquid enters the liquid conduit 1506 at the input liquid conduit 1506 and exits the liquid conduit 1506 at the conduit 1510.

During operation, heat is generated by heat generating elements 1503. The heat is transported by heat conducting material 1516. As liquid flows through cavity 1514 the heat is dissipated. In one embodiment of the present invention, the circuit board implementation of a heat transfer system 1500 is connected to any one of the foregoing heat exchange units depicted in FIGS. 1-5. As a result, cooled liquid is transported from the heat exchange system to the circuit board implementation of a heat transfer system 1500. The cooled liquid enters cavity 1514 through liquid conduit 1506. The cooled liquid is heated in cavity 1514 and exits cavity 1514 through conduit 1510.

FIG. 15D-15I display the variety of shapes that are possible for heat conducting material 1516 of FIG. 15C. Each of the shapes displayed in FIGS. 15D through 15I include a cavity, such as 1514 of FIG. 15C. The directional arrows show the flow of liquid through the cavities. It should be appreciated that the heat conducting material 1516 of FIG. 15C may be implemented with a large variety of shapes.

Thus, the present invention has been described herein with reference to a particular embodiment for a particular application. Those having ordinary skill in the art and access to the present teachings will recognize additional modifications, applications, and embodiments within the scope thereof.

It is, therefore, intended by the appended claims to cover any and all such applications, modifications, and embodiments within the scope of the present invention.

What is claimed is:

1. A complete, forced-circulation, liquid cooling system for cooling heat-generating components in an electronic system comprising:

one or more heat transfer units coupled to one or more heat-generating components for receiving cooled liquid coolant and generating heated liquid coolant by transfer of heat from the heat-generating components to the liquid coolant;

a heat exchange unit having a heat dissipater for receiving heated liquid coolant from the heat transfer units and generating cooled coolant for transportation to the heat transfer units;

a forced circulation means disposed within the heat exchange unit in proximity to the dissipater for forcing transportation, at accelerated rates, of cooled liquid coolant from the heat exchange unit to the heat transfer units and of heated liquid coolant from the heat transfer units to the heat exchange unit;

a liquid coolant pathway for delivery of the cooled liquid coolant from the heat exchange unit to the heat transfer units and for delivery of the heated liquid coolant from the heat transfer units to the heat exchange unit; and wherein the complete liquid cooling system has no component acting as a liquid coolant reservoir while the liquid cooling system is in operation.

2. The cooling system of claim 1 wherein one or more heat transfer units have an inlet for receiving cooled liquid coolant from the heat exchange unit and an outlet for receiving heated liquid coolant for transporting to the heat exchange unit, wherein the inlet is disposed below the outlet for enhancing convective circulation of the liquid coolant.

3. The cooling system of claim 1 wherein the heat exchange unit has an inlet for receiving heated liquid coolant from the heat transfer units and an outlet for cooled liquid coolant for transportation to the heat transfer units, wherein the outlet is disposed below the inlet for enhancing convective circulation of the liquid coolant.

4. The cooling system as set forth in claim 1 wherein one or more heat transfer units is comprised of a housing having one or more surfaces partially or fully open for coupling to one or more external surfaces of one or more heat-generating components and forming cavities there with and wherein the liquid coolant transported through the cavities flows across and in direct contact with the external surfaces of the heat-generating component.

5. A data processing system having the cooling system of claim 1.

6. A telecommunications system having the cooling system of claim 1.

7. An optical device having the cooling system of claim 1.

8. A system having one or more processors and having the cooling system of claim 1.

9. A method of cooling heat-generating components in an electronic system having a complete liquid cooling system, and a means for forced circulation of a liquid coolant at accelerated rates disposed in proximity to a dissipater within a heat exchange unit, and having a transportation means for transporting the liquid coolant, the method comprising the steps of:

heating liquid coolant within one or more heat transfer units coupled to one or more heat-generating components by transferring heat from the heat-generating components to the liquid coolant thereby creating heated liquid coolant for transportation by forced circulation to the heat exchange unit;

receiving the heated liquid coolant from the heat transfer units at the heat exchange unit;

cooling the heated liquid coolant within the heat exchange unit, thereby creating cooled liquid coolant, for transportation to the heat transfer units;

receiving cooled coolant from the heat exchange unit at the heat transfer units; and wherein all of the above steps are performed in the complete liquid cooling system having no component acting as a reservoir for the liquid coolant while the liquid cooling system is in operation.

10. The method of claim 9 wherein one or more heat transfer units have an inlet for receiving cooled liquid coolant from the heat exchange unit and an outlet for transporting heated liquid coolant to the heat exchange unit, the method further comprising the step of:

positioning the inlet below the outlet, for enhancing convective circulation of the liquid coolant.

11. The method of claim 9 wherein the heat exchange unit has an inlet for receiving heated liquid coolant from the heat transfer units and an outlet for transporting cooled liquid coolant to the heat transfer units, the method further comprising the step of:

positioning the inlet above the outlet, for enhancing convective circulation of the liquid coolant.

12. The method of claim 9 wherein one or more heat transfer units is comprised of a housing having one or more surfaces partially or fully open for coupling to one or more external surfaces of one or more heat-generating components and forming cavities there with and wherein the liquid coolant transported through the cavities flows across and in direct contact with the external surfaces of the heat-generating component, the method further comprising the step of:

removing heat from one or more heat-generating components into the liquid coolant by direct contact of the coolant with the heat-generating components.

13. A cooling system for cooling heat-generating components in an electronic system, the cooling system having one or more heat transfer units thermally coupled to one or more heat-generating components, coolant pathways for transporting a coolant through the cooling system, a heat exchange unit and no component in the cooling system acting as a reservoir while the cooling system is in operation, the heat exchange unit comprising:

an input cavity for receiving heated coolant from the heat transfer units and distributing the heated coolant;

a dissipater for receiving the distributed heated coolant from the input cavity and cooling the coolant;

an output cavity for receiving the cooled coolant from the dissipater and directing the cooled coolant to the heat transfer units; and a forced circulation means disposed in the heat exchange unit for forcing circulation of the coolant through the cooling system; and wherein the cooling system, including the heat exchange unit, has no component acting as a reservoir while the cooling system is in operation.

14. The cooling system as set forth in claim 13 wherein the input cavity is disposed above the output cavity for enhancing convective circulation of the coolant.

15. The cooling system as set forth in claim 13 wherein the force circulation means is a pump is disposed in the heat exchange unit.

16. The cooling system as set forth in claim 13 wherein the pump is a self-priming pump.

17. The cooling system as set forth in claim 15 wherein the pump is disposed in the output cavity.

18. The cooling system as set forth in claim 17 wherein the pump includes an impeller disposed horizontally at the very bottom of the output cavity.

19. The cooling system as set forth in claim 15 wherein the pump includes an impeller disposed horizontally at the very bottom of the heat exchange unit.

20. The cooling system as set forth in claim 18 wherein the impeller includes one or more blades with slanted surfaces inverted so as to improve the flow of coolant out of the heat exchange unit at the bottom there of.

21. The cooling system as set forth in claim 15 wherein the pump includes an impeller, the heat exchange unit further comprising:

a motor; and a shaft coupled to the motor and to the impeller for operating the pump.

22. The cooling system as set forth in claim 21 wherein no seal is required for the pump.

23. The cooling system as set forth in claim 13 wherein the dissipater further comprises a plurality of coolant pathways for transporting the heated coolant through the dissipater.

24. The cooling system as set forth in claim 23 wherein one or more of the coolant pathways includes means for creating non-laminar flow of the coolant for enhancing the transfer of heat from the coolant to the dissipater.

25. A data processing system having the cooling system of claim 13.

26. A telecommunications system having the cooling system of claim 13.

27. An optical device having the cooling system of claim 13.

28. A system having one or more processors and having the cooling system of claim 13.

29. A method of cooling heat-generating components in an electronic system having a cooling system, the cooling system having one or more heat transfer units thermally coupled to one or more heat-generating components, a heat exchange unit, forced circulation means disposed in the heat exchange unit for forcing circulation of a coolant through the cooling system; coolant pathways for transporting the coolant through the cooling system, and no component in the cooling system acting as a reservoir while the cooling system is in operation, the method comprising the steps of:

receiving heated coolant from the heat transfer units at an input cavity of the heat exchange unit and distributing the heated coolant to a dissipater;

cooling the coolant in the dissipater;

receiving the cooled coolant from the dissipater at an output cavity for directing the cooled coolant to the heat transfer units; and wherein all of the above steps are performed in the cooling system, including the heat exchange unit, having no component acting reservoir while the cooling system is in operation.

30. The method of claim 29 further comprising the step of:

positioning the input cavity above the output cavity for enhancing convective circulation of the coolant.

31. The method of claim 29 wherein at least one of the heat transfer units is comprised of a housing having one or more surfaces partially or fully open for coupling to one or more external surfaces of the heat-generating components and forming cavities there with and wherein the coolant transported through the cavities flows across and in direct contact with the external surfaces of the heat-generating component, the method further comprising the step of:

removing heat from one or more heat-generating components into the coolant by direct contact of the coolant with the heat-generating components.

32. The method of claim 29 wherein one or more of the heat transfer units further comprises an inlet for receiving cooled coolant from the heat exchange unit and an outlet for receiving heated coolant for transfer to the heat exchange unit, the method further comprising the step of:

positioning the inlet below the outlet, for enhancing convective circulation of the coolant.

* * * * *